US009498948B2

(12) United States Patent
Arakane

(10) Patent No.: US 9,498,948 B2
(45) Date of Patent: Nov. 22, 2016

(54) INKJET PRINTER WITH A CONTROLLER THAT CORRECTS INK-DISCHARGING TIMINGS

(71) Applicant: Satoru Arakane, Aichi (JP)

(72) Inventor: Satoru Arakane, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/158,000

(22) Filed: Jan. 17, 2014

(65) Prior Publication Data

US 2014/0204141 A1 Jul. 24, 2014

(30) Foreign Application Priority Data

Jan. 18, 2013 (JP) ..... 2013-007643

(51) Int. Cl.
*B41J 2/045* (2006.01)

(52) U.S. Cl.
CPC ..... *B41J 2/04556* (2013.01); *B41J 2/0454* (2013.01); *B41J 2/0456* (2013.01); *B41J 2/0458* (2013.01); *B41J 2/04508* (2013.01); *B41J 2/04573* (2013.01)

(58) Field of Classification Search
None
See application file for complete search history.

(56) References Cited

U.S. PATENT DOCUMENTS 5,874,979 A * 2/1999 Ohyama ..... 347/104
6,471,315 B1 10/2002 Kurata
7,237,858 B2 * 7/2007 Igarashi ..... 347/8
8,567,905 B2 10/2013 Ogasawara
2004/0126164 A1 * 7/2004 Ohyama ..... 400/58
2005/0088471 A1 4/2005 Endo
2007/0291056 A1 12/2007 Tanahashi et al.
2009/0219322 A1 9/2009 Terada
2009/0262157 A1 10/2009 Sato et al.
2010/0039473 A1 2/2010 Terada
2010/0244357 A1 9/2010 Takahata
2011/0063352 A1 3/2011 Sakurada et al.
(Continued)

FOREIGN PATENT DOCUMENTS

JP HEI 05-155009 A 6/1993
JP HEI 9-48161 A 2/1997
(Continued)

OTHER PUBLICATIONS

U.S. Office Action dated Sep. 4, 2014 received in related U.S. Patent Application, namely U.S. Appl. No. 14/107,035.
(Continued)

*Primary Examiner* — Bradley Thies
(74) *Attorney, Agent, or Firm* — Scully, Scott, Murphy & Presser, PC

(57) ABSTRACT

An inkjet printer including a recording head, a carriage being movable with the recording head along a scanning direction, a corrugation mechanism to form a corrugated shape having alternately formed protrusive points and recessed points in the sheet along the scanning direction, and a controller is provided. The controller executes steps including a discharged ink amount calculating step, a timing information obtaining step, a discharging timing correcting step, and a discharging step.

12 Claims, 15 Drawing Sheets

| REFERENCE VALUE | D0 | | | | | | | | |
|---|---|---|---|---|---|---|---|---|---|
| PEAK DEVIATION VALUE | $Y_{(2)}$ | $Y_{(4)}$ | $Y_{(6)}$ | $Y_{(8)}$ | $Y_{(10)}$ | $Y_{(12)}$ | $Y_{(14)}$ | $Y_{(16)}$ | |
| BOTTOM DEVIATION VALUE | $Y_{(1)}$ | $Y_{(3)}$ | $Y_{(5)}$ | $Y_{(7)}$ | $Y_{(9)}$ | $Y_{(11)}$ | $Y_{(13)}$ | $Y_{(15)}$ | $Y_{(17)}$ |
| DISCHARGED INK AMOUNT | 0 | $V_1$ | $V_2$ | $V_3$ | $V_4$ | $V_5$ | ... | | |
| PEAK ADJUSTING VALUE | 1 | $\alpha_1$ | $\alpha_2$ | $\alpha_3$ | $\alpha_4$ | $\alpha_5$ | ... | | |
| BOTTOM ADJUSTING VALUE | 1 | $\beta_1$ | $\beta_2$ | $\beta_3$ | $\beta_4$ | $\beta_5$ | ... | | |

(56) References Cited

U.S. PATENT DOCUMENTS

| | | | | |
|---|---|---|---|---|
| 2011/0157269 | A1* | 6/2011 | Teramae | 347/14 |
| 2011/0175958 | A1* | 7/2011 | Sato et al. | 347/14 |
| 2011/0298854 | A1 | 12/2011 | Sakurada et al. | |
| 2012/0050406 | A1 | 3/2012 | Ogasawara | |
| 2013/0257939 | A1 | 10/2013 | Arakane | |
| 2014/0168300 | A1 | 6/2014 | Kubo et al. | |
| 2014/0204141 | A1 | 7/2014 | Arkane | |

FOREIGN PATENT DOCUMENTS

| | | | |
|---|---|---|---|
| JP | HEI 11-240146 | A | 9/1999 |
| JP | 2003-251800 | A | 9/2003 |
| JP | 2004-017586 | A | 1/2004 |
| JP | 2004-106978 | A | 4/2004 |
| JP | 2005-246642 | A | 9/2005 |
| JP | 2006-102997 | A | 4/2006 |
| JP | 2006-192636 | A | 7/2006 |
| JP | 2007-144718 | A | 6/2007 |
| JP | 2007-331297 | A | 12/2007 |
| JP | 2007-331315 | A | 12/2007 |
| JP | 2008-221729 | A | 9/2008 |
| JP | 2009-128822 | A | 6/2009 |
| JP | 2009-143152 | A | 7/2009 |
| JP | 2009-196367 | A | 9/2009 |
| JP | 2009-202430 | A | 9/2009 |
| JP | 2009-208273 | A | 9/2009 |
| JP | 2010-042646 | A | 2/2010 |
| JP | 2011-079296 | A | 4/2011 |
| JP | 2011-148123 | A | 8/2011 |
| JP | 2014-136419 | A | 7/2014 |
| JP | 2014-139002 | A | 7/2014 |

OTHER PUBLICATIONS

U.S. Office Action dated Nov. 19, 2014 received in related U.S. Patent Application, namely U.S. Appl. No. 14/341,015.

U.S. Office Action dated Nov. 20, 2014 received in related U.S. Patent Application, namely U.S. Appl. No. 14/341,080.

U.S. Patent Application filed Jul. 25, 2014, namely U.S. Appl. No. 14/341,080.

U.S. Patent Application filed Jul. 25, 2014, namely U.S. Appl. No. 14/341,015.

Notice of Allowance dated Mar. 20, 2015 issued in U.S. Appl. No. 14/341,015.

Notice of Allowance dated Mar. 5, 2015 issued in U.S. Appl. No. 14/341,080.

Notice of Allowance dated Feb. 11, 2015 issued in U.S. Appl. No. 14/107,035.

U.S. Office Action dated Sep. 25, 2015 issued in U.S. Appl. No. 14/600,208.

Notice of Allowance dated May 9, 2016 issued in U.S. Appl. No. 14/600,208.

Japanese Office Action dated Feb. 9, 2016 received in corresponding Japanese Patent Application No. 2013-007643.

* cited by examiner

| REFERENCE VALUE | D0 | | | | | | | | |
|---|---|---|---|---|---|---|---|---|---|
| PEAK DEVIATION VALUE | $Y_{(2)}$ | $Y_{(4)}$ | $Y_{(6)}$ | $Y_{(8)}$ | $Y_{(10)}$ | $Y_{(12)}$ | $Y_{(14)}$ | $Y_{(16)}$ | |
| BOTTOM DEVIATION VALUE | $Y_{(1)}$ | $Y_{(3)}$ | $Y_{(5)}$ | $Y_{(7)}$ | $Y_{(9)}$ | $Y_{(11)}$ | $Y_{(13)}$ | $Y_{(15)}$ | $Y_{(17)}$ |
| DISCHARGED INK AMOUNT | 0 | $V_1$ | $V_2$ | $V_3$ | $V_4$ | $V_5$ | ... | | |
| PEAK ADJUSTING VALUE | 1 | $\alpha_1$ | $\alpha_2$ | $\alpha_3$ | $\alpha_4$ | $\alpha_5$ | ... | | |
| BOTTOM ADJUSTING VALUE | 1 | $\beta_1$ | $\beta_2$ | $\beta_3$ | $\beta_4$ | $\beta_5$ | ... | | |

FIG. 10

| REFERENCE VALUE | D0 | | | | | | | | |
|---|---|---|---|---|---|---|---|---|---|
| PEAK DEVIATION VALUE | $Y_{(2)}$ | $Y_{(4)}$ | $Y_{(6)}$ | $Y_{(8)}$ | $Y_{(10)}$ | $Y_{(12)}$ | $Y_{(14)}$ | $Y_{(16)}$ | |
| BOTTOM DEVIATION VALUE | $Y_{(1)}$ | $Y_{(3)}$ | $Y_{(5)}$ | $Y_{(7)}$ | $Y_{(9)}$ | $Y_{(11)}$ | $Y_{(13)}$ | $Y_{(15)}$ | $Y_{(17)}$ |
| DISCHARGED INK AMOUNT | 0 | $V_1$ | $V_2$ | $V_3$ | $V_4$ | $V_5$ | ... | | |
| ADJUSTING VALUE | 1 | $\gamma_1$ | $\gamma_2$ | $\gamma_3$ | $\gamma_4$ | $\gamma_5$ | ... | | |

FIG. 13

INKJET PRINTER WITH A CONTROLLER THAT CORRECTS INK-DISCHARGING TIMINGS

CROSS-REFERENCE TO RELATED APPLICATION

This application claims priority under 35 U.S.C. §119 from Japanese Patent Application No. 2013-007643 filed on Jan. 18, 2013. The entire subject matter of the application is incorporated herein by reference.

BACKGROUND

1. Technical Field

The following description relates to an inkjet printer capable of recording an image on a recording sheet formed in a wavy shape waving along a main scanning direction.

2. Related Art

An inkjet printer configured to record an image by discharging ink from a recording head onto a recording sheet is known. The inkjet printer may be equipped with a wave forming mechanism to deform the recording sheet in a wavy shape waving up and down along a main scanning direction, which interests a direction to convey the recording sheet. While the recording sheet is deformed in the wavy shape, an amount of a gap between the recording head and the recording sheet may not be constant but may fluctuate along the main scanning direction depending on convexity and concavity in the wavy shape in the recording sheet. Due to the inconstant gap amount, while the amount of the gap between the convex portion and the recording head tends to be smaller and the amount of the gap between the concave portion and the recording head tends to be larger, positions of the ink droplets landing on the recording sheet may be deviated from initially targeted positions. Therefore, it may be necessary to adjust timings to discharge the ink in consideration of the convexity and the concavity of the wavy shape in the recording sheet so that the adjusted timings may absorb the deviation of the landing positions on the recording sheet.

SUMMARY

In the above-mentioned recording apparatus, the timings to discharge the ink may be corrected with regard to a condition of a dry recording sheet, on which no ink is discharged yet. However, amplitude of the ripples formed in the recording sheet may change between the condition of the dry recording sheet before the image is recorded thereon and a condition of a wet recording sheet swelled by the landed ink after the ink is discharged thereon. Therefore, due to the change of the amplitude in the ripples of the recording sheet, the ink may still not be discharged onto the targeted positions even in the corrected timings.

Aspects of the present invention are advantageous in that an inkjet printer, in which ink is discharged onto a recording sheet, deformed in a wavy shape along a main scanning direction, in preferable timings adjusted in accordance with an amount of the ink to be discharged, is provided.

According to an aspect of the present invention, an inkjet printer is provided. The inkjet printer includes a recording head, a carriage, a corrugation mechanism, and a controller. The recording head is configured to discharge ink at a sheet. The carriage has the recording head and is configured to move along a scanning direction. The corrugation mechanism is configured to form a corrugated shape that has protrusive points protruding toward the recording head and recessed points recessed from the recording head in the sheet, while each of the protruding points and each of the recessed points are arranged alternately along the scanning direction. The controller is configured to execute steps, including a discharged ink amount calculating step, a timing information obtaining step, a discharging timing correcting step, and a discharging step. The discharged ink amount calculating step is a step in which an amount of the ink having been discharged from the recording head at the sheet is calculated. The timing information obtaining step is a step in which information concerning discharging timings for discharging the ink at the protrusive points and the recessed points respectively are obtained. The discharging timing correcting step is a step in which the discharging timings for the protrusive points and the recessed points are corrected individually in accordance with the calculated amount of the discharged ink. The discharging step is a step in which the carriage is moved along the scanning direction and the recording head is manipulated to discharge the ink at the sheet in the corrected discharging timings.

According to another aspect of the present invention, an inkjet printer is provided. The inkjet printer includes a recording head, a carriage, a corrugation mechanism, and a controller. The recording head is configured to discharge ink at a sheet. The carriage has the recording head and is configured to move along a scanning direction. The corrugation mechanism is configured to form a corrugated shape that has protrusive points protruding toward the recording head and recessed points recessed from the recording head in the sheet, each of the protruding points and each of the recessed points being arranged alternately along the scanning direction. The controller is configured to execute steps, including a discharged ink amount calculating step, a timing information obtaining step, a discharging timing correcting step, and a discharging step. The discharged ink amount calculating step is a step in which an amount of the ink having been discharged at the sheet is calculated. The timing information obtaining step is a step in which information concerning discharging timings for discharging the ink at the protrusive points, the recessed points, and other points being between the recessed points and the protrusive points respectively is obtained. The discharging timing correcting step is a step in which the discharging timings are corrected in accordance with the calculated amount of the discharged ink. The discharging step is a step in which the recording head is moved along the scanning direction and is manipulated to discharge the ink at the sheet in the corrected discharging timings.

According to still another aspect of the present invention, a method to record an image by discharging ink from a recording head at a corrugated sheet is provided. The method includes calculating an amount of the ink having been discharged at the sheet from the recording head mounted on a carriage, while the carriage is movable along a scanning direction; obtaining information concerning discharging timings from a memory device, the information concerning the discharging timings for discharging the ink at protrusive points and recessed points formed in the corrugated sheet; correcting the discharging timings for the protrusive points and the recessed points in accordance with the calculated amount of the discharged ink; and moving the carriage along the scanning direction and manipulating the recording head to discharge the ink at the sheet in the corrected discharging timings.

BRIEF DESCRIPTION OF THE ACCOMPANYING DRAWINGS

Figure 5:
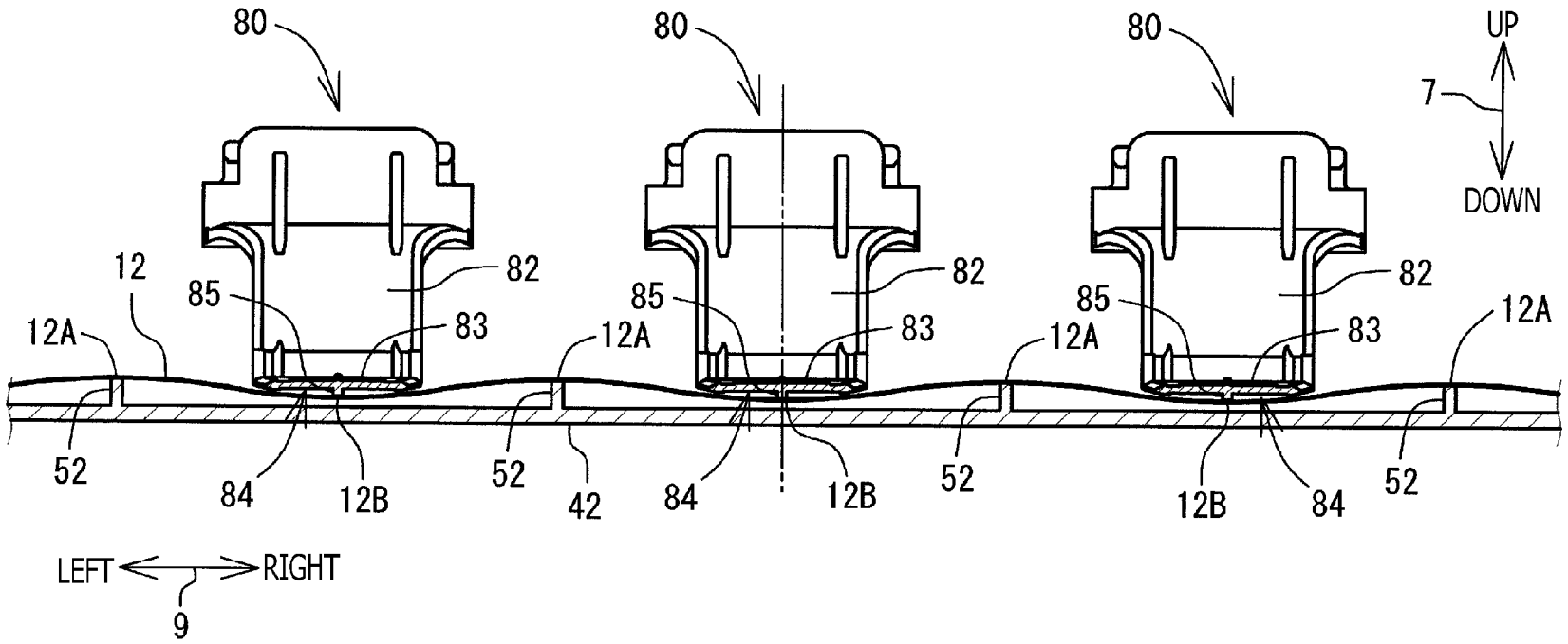

FIG. 5 is a cross-sectional view to illustrate relative positions between supporting ribs 52 in the platen 42 and contacting ribs 85 in the contact pieces 80 in the MFD 10 according to the embodiment of the present invention.

Figure 6:
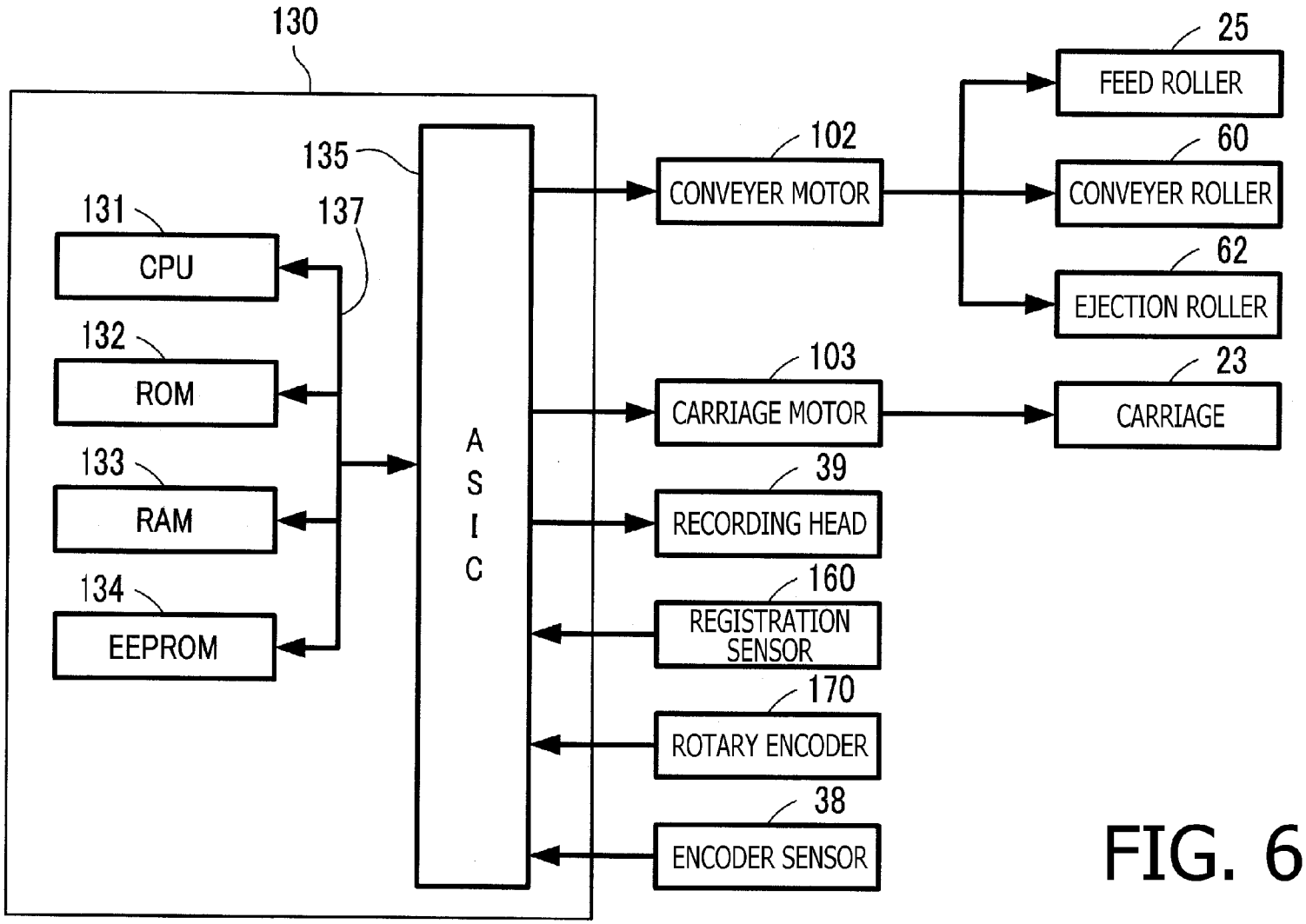

FIG. 6 is a block diagram to illustrate configurations of a controller 130 and other related parts in the MFD 10 according to the embodiment of the present invention.

Figure 7:
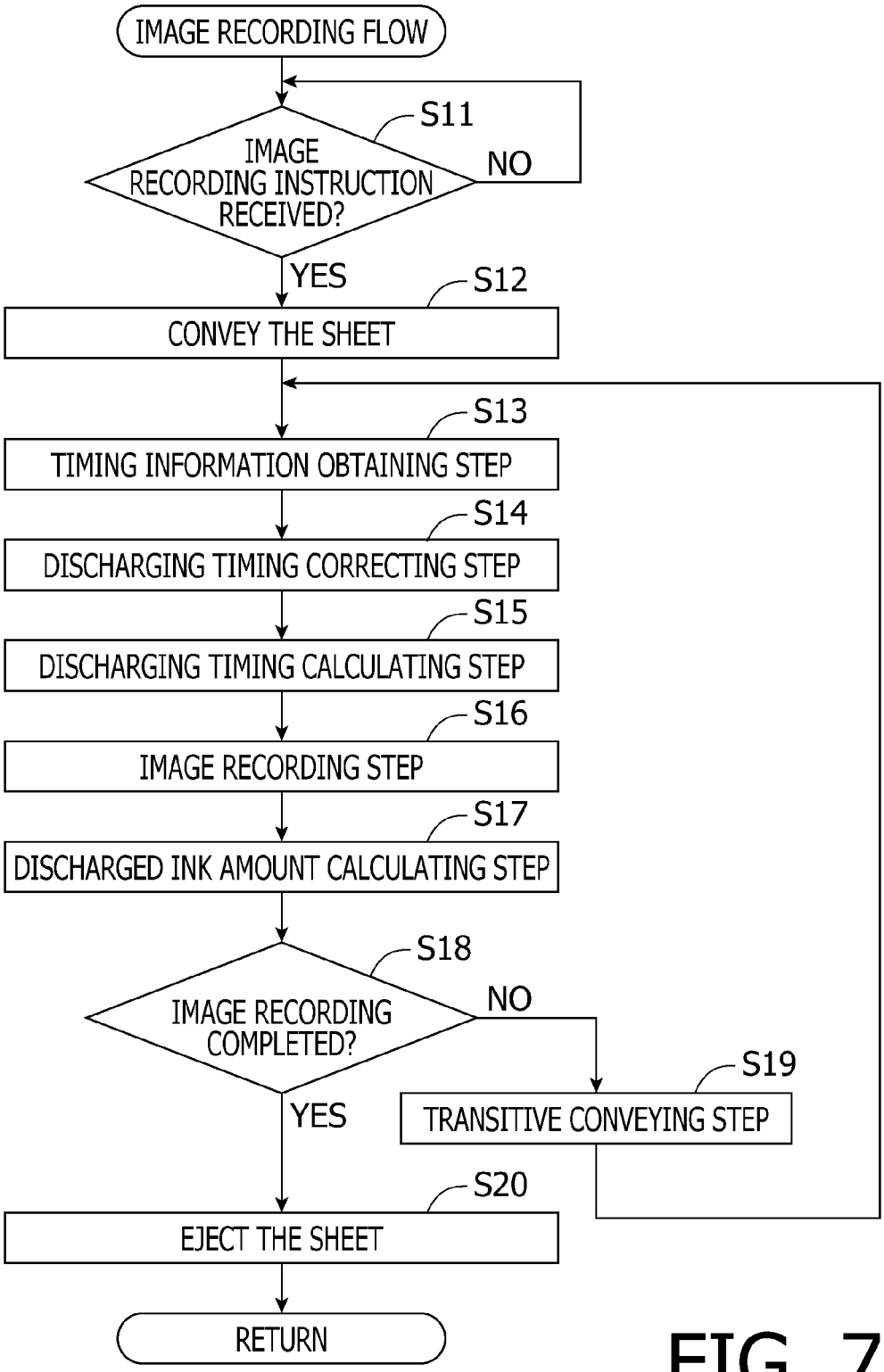

FIG. 7 is a flowchart to illustrate a flow of an image recording operation to be performed by the controller 130 in the MFD 10 according to the embodiment of the present invention.

Figure 8:
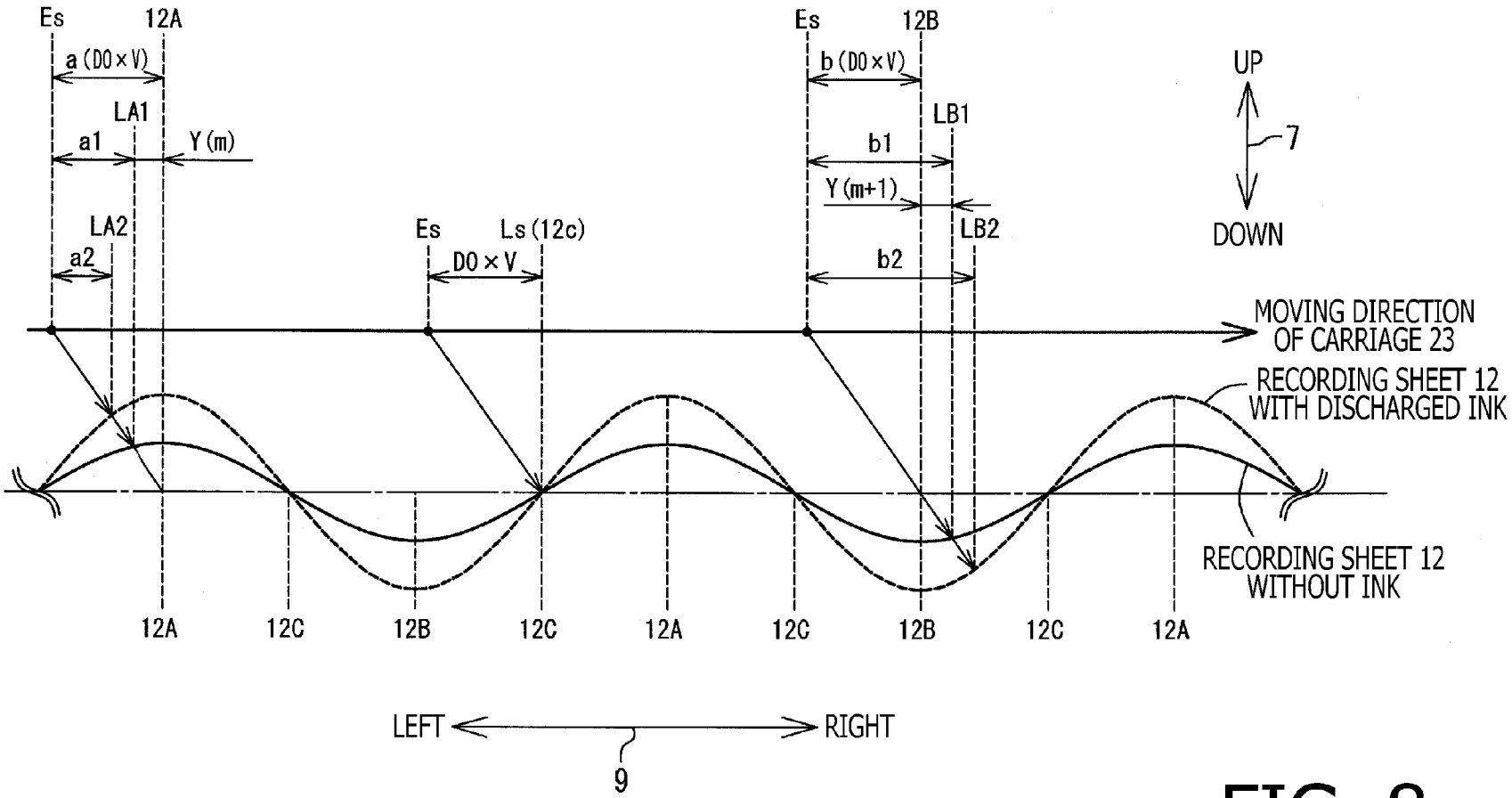

FIG. 8 is a diagram to illustrate a reference value D0, a peak deviation value Y (m), and a bottom deviation value Y (m+1) with respect to the recording sheet 12 in the MFD 10 according to the embodiment of the present invention.

Figure 9:
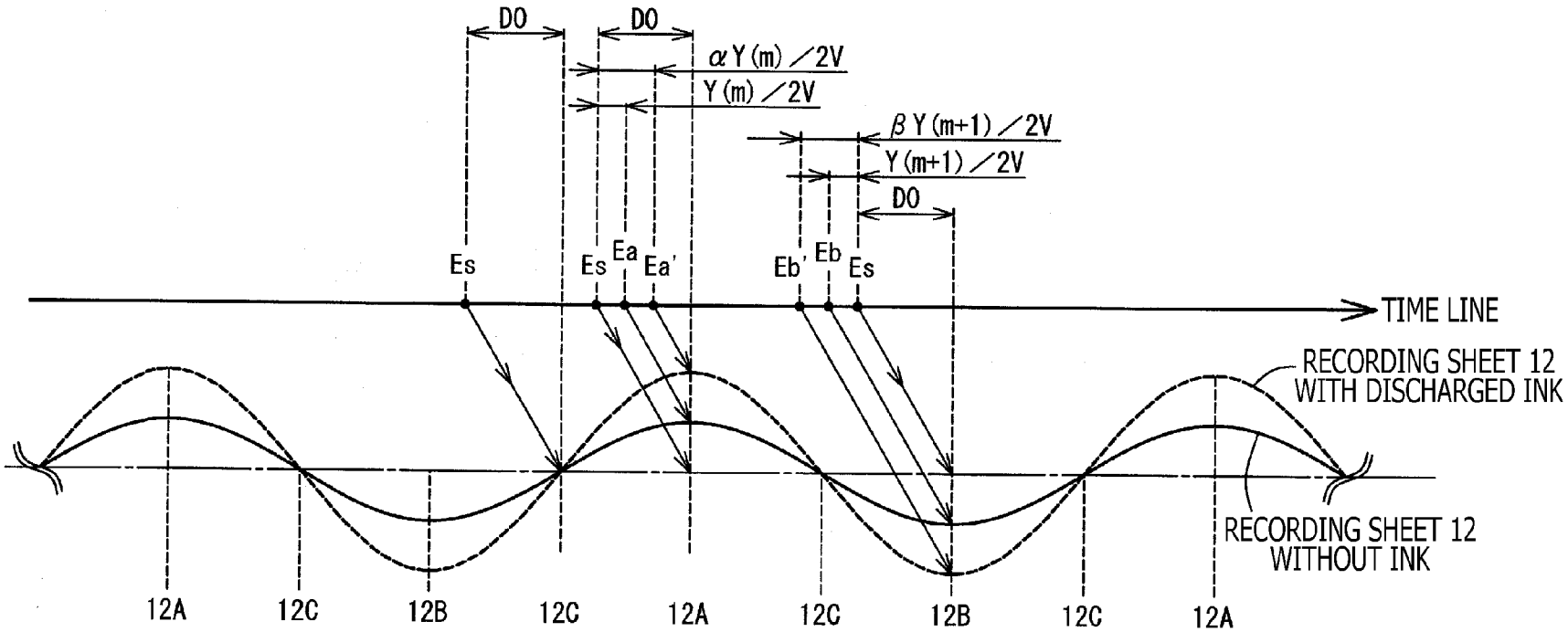

FIG. 9 is a diagram to illustrate a shape of a dry recording sheet 12, before the ink is discharged thereon, and a shape of a wet recording sheet 12, after the ink is discharged thereon, used in the MFD 10 according to the embodiment of the present invention.

FIG. 10 illustrates a data structure in an EEPROM 134 in the MFD 10 according to the embodiment of the present invention.

Figure 11:
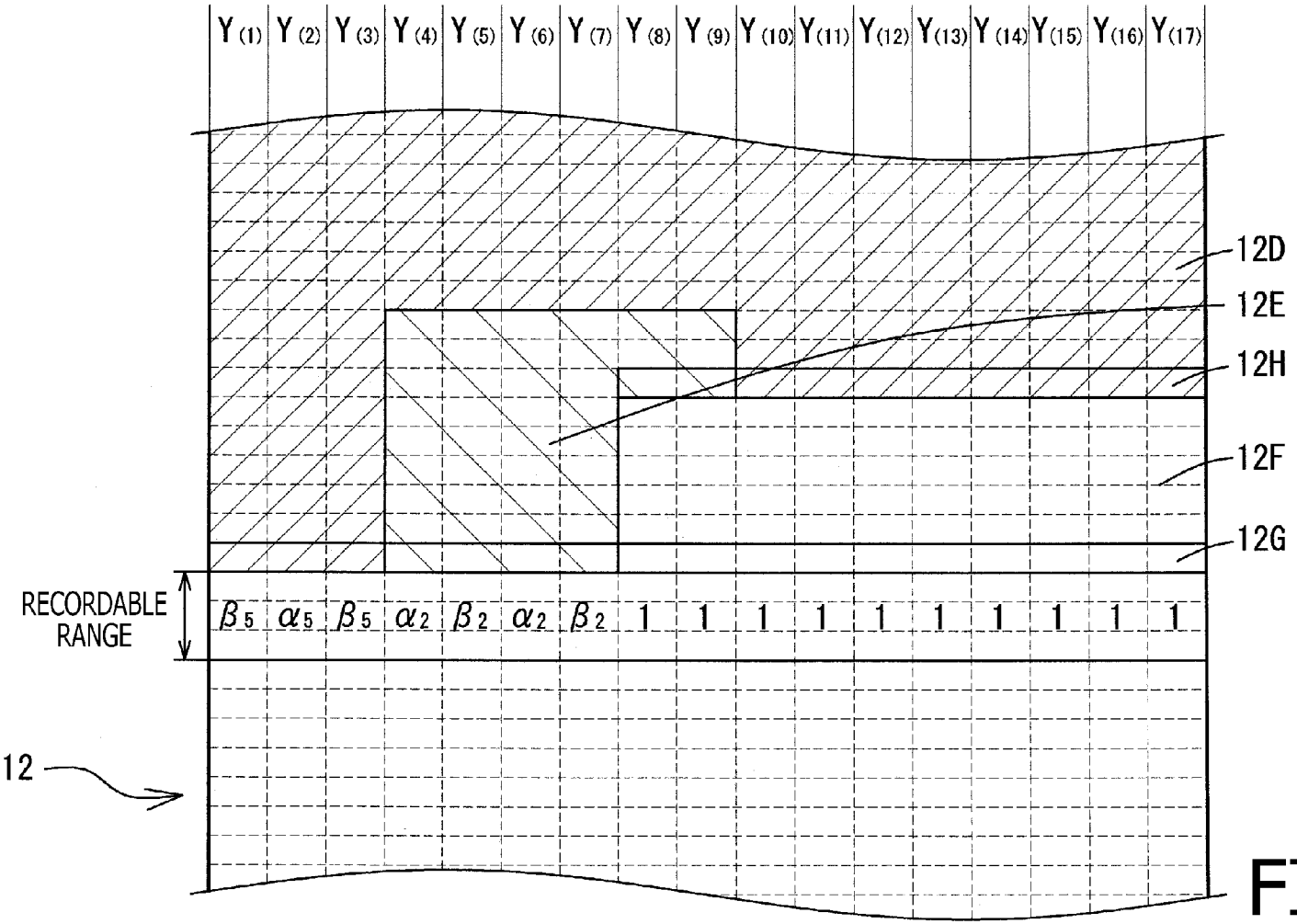

FIG. 11 is a diagram indicating amounts of discharged ink on the recording sheet 12 used in the MFD 10 according to the embodiment of the present invention.

Figure 12:
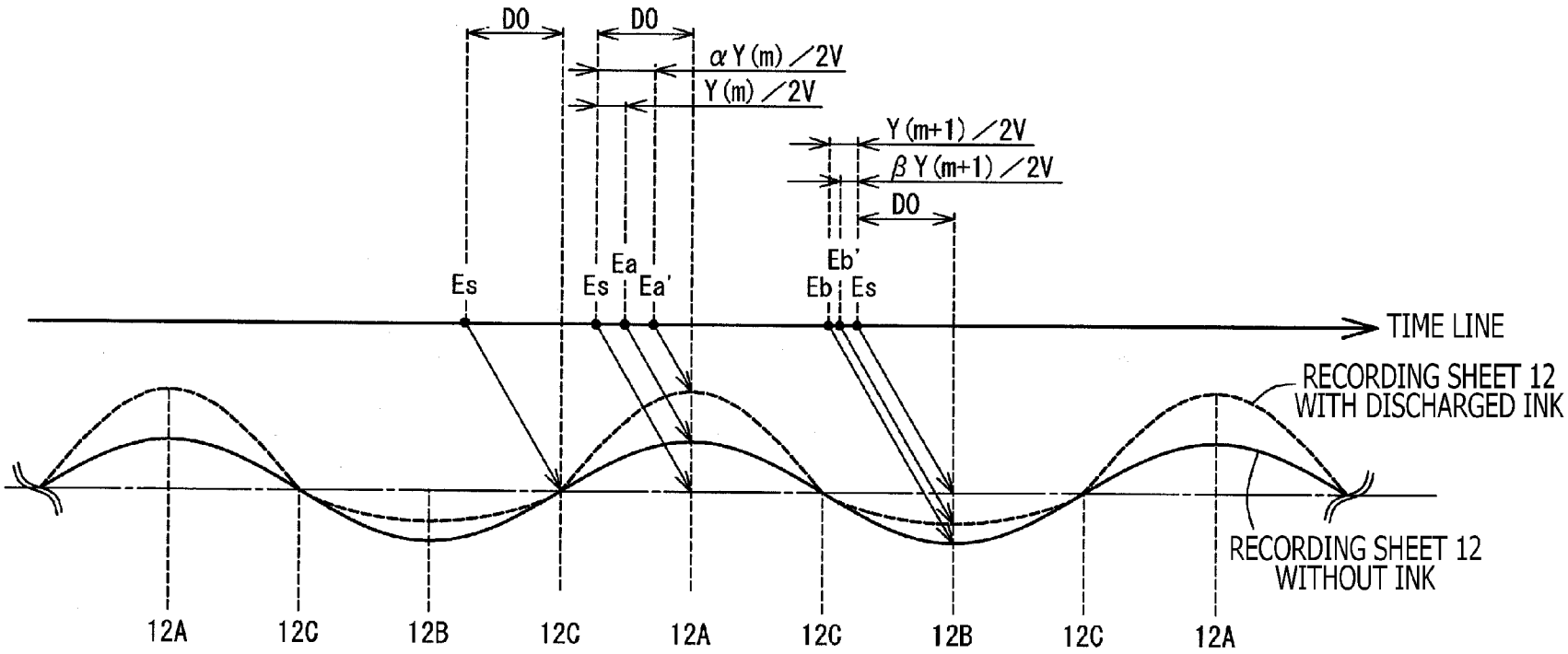

FIG. 12 is a diagram to illustrate a shape of a dry recording sheet 12, before the ink is discharged thereon, and a shape of a wet recording sheet 12, after the ink is discharged thereon, used in the MFD 10 in a first modified example according to the embodiment of the present invention.

FIG. 13 illustrates a data structure in the EEPROM 134 in the MFD 10 in a second modified example according to the embodiment of the present invention.

Figure 14A:
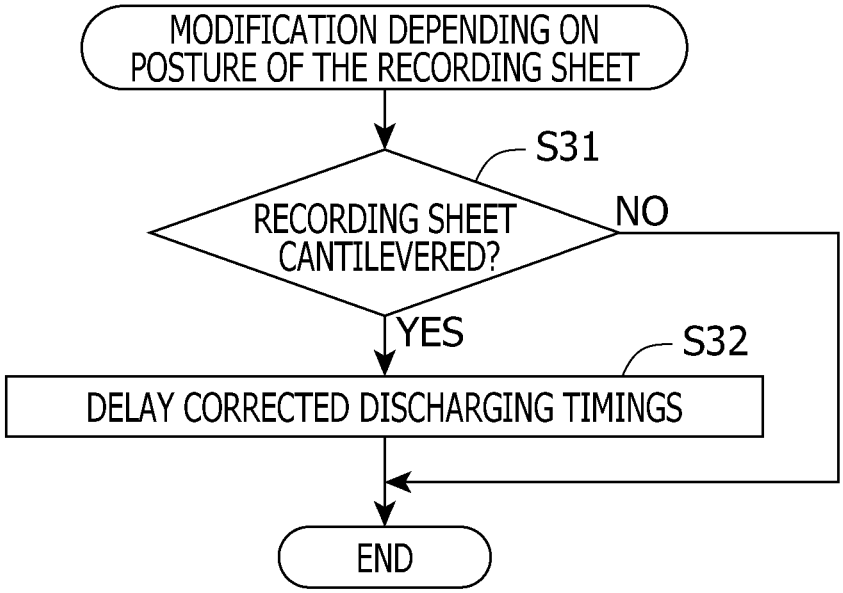
Figure 14B:
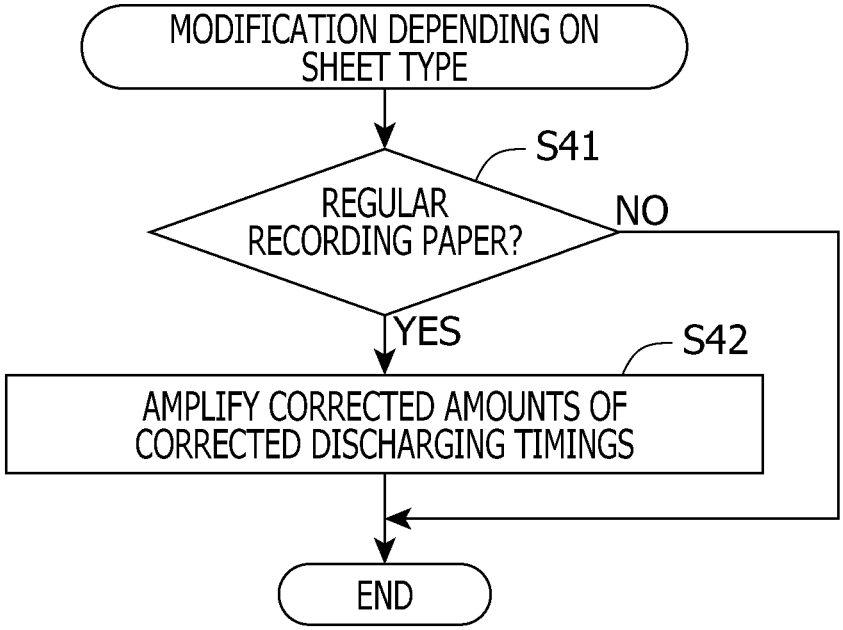
Figure 14C:
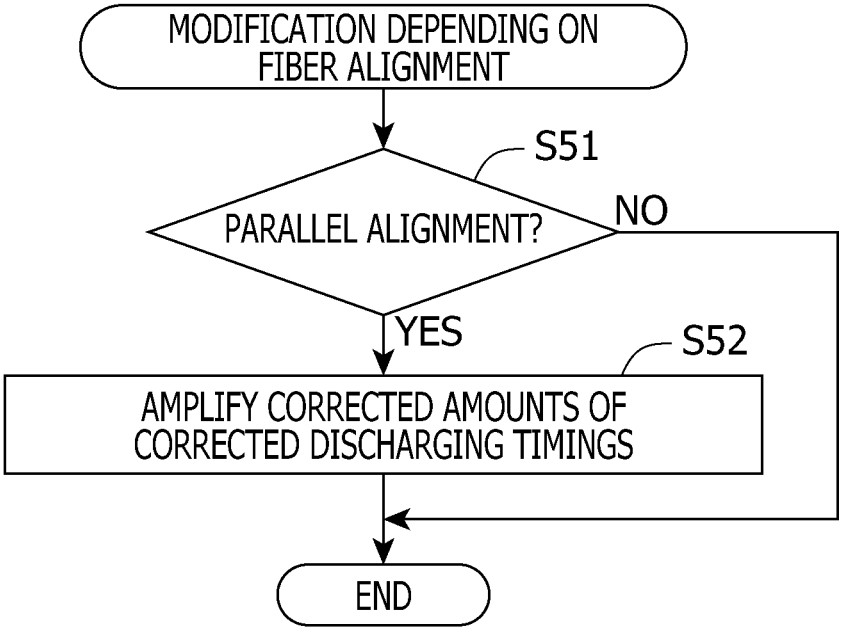

FIG. 14A is a flowchart to illustrate an operation to modify corrected discharging timings depending on a nipping condition of the recording sheet 12 in the MFD 10 according to the embodiment of the present invention. FIG. 14B is a flowchart to illustrate an operation to modify corrected discharging timings depending on a type the recording sheet 12 in the MFD 10 according to the embodiment of the present invention. FIG. 14C is a flowchart to illustrate an operation to modify corrected discharging timings depending on a fiber alignment in the recording sheet 12 in the MFD 10 according to the embodiment of the present invention.

Figure 14D:
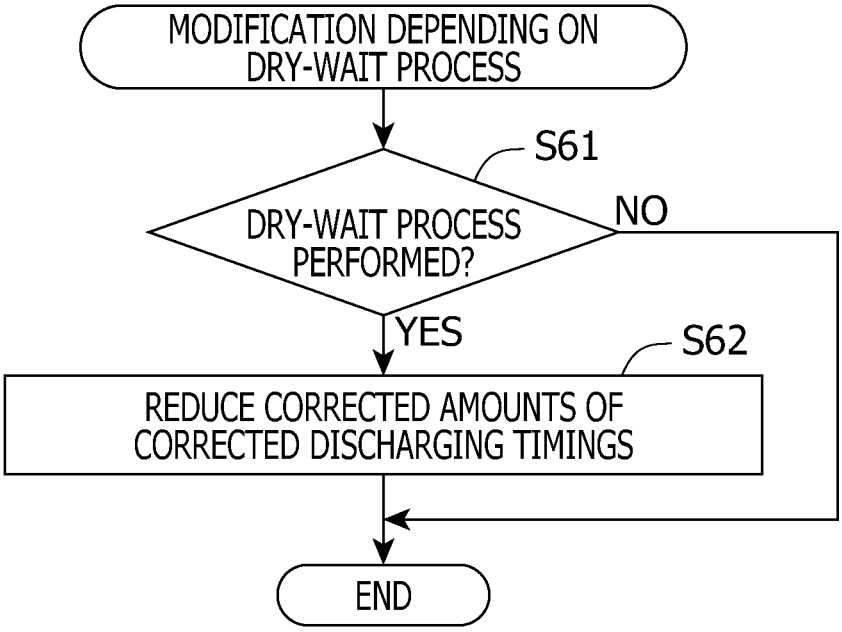

FIG. 14D is a flowchart to illustrate an operation to modify corrected discharging timings depending on dry-wait period applied to the recording sheet 12 in the MFD 10 according to the embodiment of the present invention.

DETAILED DESCRIPTION

Hereinafter, an embodiment according to aspects of the present invention will be described in detail with reference to the accompanying drawings. It is noted that various connections are set forth between elements in the following description. These connections in general and, unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 will be referred to based on the ordinarily usable posture of the MFD 10: a viewer's lower-left side in FIG. 1, on which an opening 13 is formed, is defined to be a front side of the MFD 10, and a side opposite from the front side, i.e., a viewer's upper-right side, is defined as a rear side of the MFD 10. A front-to-rear or rear-to-front direction is defined as a direction of depth and may be referred to as a front-rear direction 8. An upper-left side in FIG. 1, which comes on the user's left-hand side with respect to the MFD 10 when the user faces the front side, is referred to as a left side or a left-hand side. A side opposite from the left, which is on the viewer's lower-right side, is referred to as a right side or a right-hand side. A right-to-left or left-to-right direction of the MFD 10 may also be referred to as a right-left direction 9 or a widthwise direction 9. The directions shown in FIGS. 2-5 and 8-9 correspond to those indicated by the arrows appearing in FIG. 1.

[Overall Configuration of the MFD 10]

Figure 1:
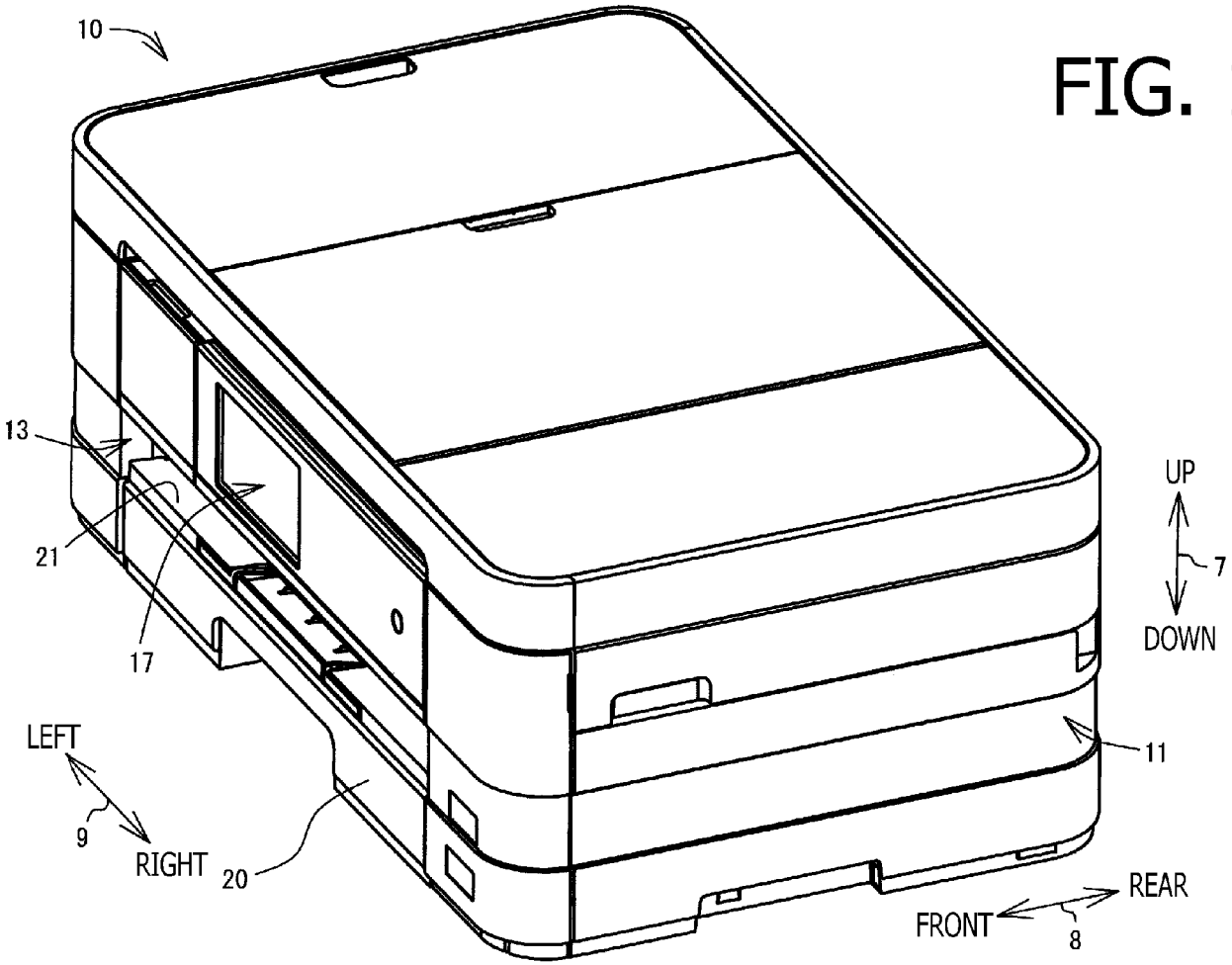
FIG. 1 is an external perspective view of a multifunction device (MFD) 10 according to an embodiment of the present invention.

As depicted in FIG. 1, the MFD 10 has an overall shape of a six-sided rectangular box and contains a printer part 11, in which an image can be recorded on a recording sheet 12 (see FIG. 2) in an inkjet recording method, in a lower position thereof. In other words, the MFD 10 is equipped with a printing function. The MFD 10 is a multi-functional device having a plurality of functions, including, for example, a facsimile transmission receiving function and a scanning function, additionally to the printing function. In the following description, however, description of configurations concerning the functions other than the printing function will be omitted.

The printer part 11 is formed to have an opening 13 on a front side thereof. Through the opening 13, a feeder tray 20 to accommodate the recording sheets 12 may be detachably attached to the printer part 11. An ejection tray 21 to catch ejected recording sheets 12 is arranged in an upper position with respect to the feeder tray 21.

Figure 2:
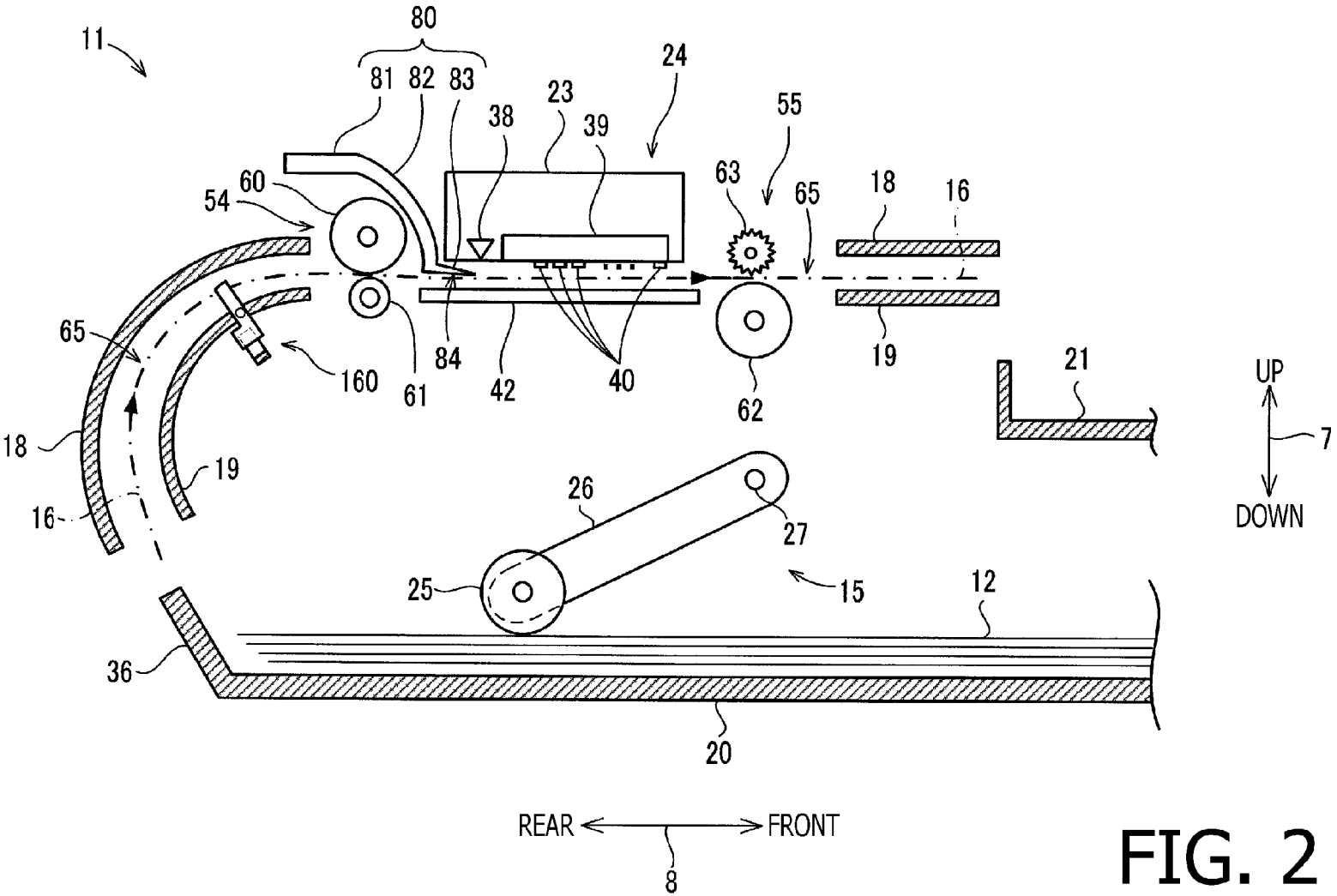
FIG. 2 is a cross-sectional view of an internal structure of a printer unit 11 in the MFD 10 according to the embodiment of the present invention.

As depicted in FIG. 2, the printer part 11 includes a feeder unit 15, a conveyer roller unit 54, a recording unit 24, an ejection roller unit 55, a platen 42, and contact pieces 80. The feeder unit 15 is configured to pick up the recording sheet 12 from the feeder tray 20 and feed the picked-up recording sheet 12 in a conveyer path 65. The conveyer roller unit 54 conveys the recording sheet 12 fed by the feeder unit 15 in the conveyer path 65 further toward a downstream along a direction of conveyed flow 16. The recording unit 24 records an image on the recording sheet 12 conveyed by the conveyer roller unit 54. The ejection roller unit 55 ejects the recording sheet 12 with the image recorded thereon by the recording unit 24 in the ejection tray 21. The platen 42 supports the recording sheet 12 being conveyed by the conveyer roller unit 54 from below. The contact pieces 80 press the recording sheet 12 being conveyed by the conveyer roller unit 54 downward toward the platen 42.

[Feeder Unit 15]

As depicted in FIG. 2, in an upper position with respect to the feeder tray 20 which is attached through the opening 13 in the printer part 11, the feeder unit 15 is arranged. The feeder unit 15 includes a feed roller 25, a feeder arm 26, and a shaft 27. The feed roller 25 is rotatably attached to one end of the feeder arm 26, which is movable upward and downward to be closer to and farther from the feeder tray 20. The feed roller 25 is rotatable by a driving force, which is generated by a conveyer motor 102 (see FIG. 6). The feeder arm 26 is pivotably supported by the shaft 27, which is supported by a frame (not shown) of the printer part 11. The feeder arm 26 is urged downward by weight thereof and/or resilient force provided by, for example, a spring. When one or more recording sheets 12 are placed in the feeder tray 20, and when the feed roller 25 rotates, a topmost one of the recording sheets 12 placed in the feeder tray 20 is picked up and fed in the conveyer path 65. Below is description of the conveyer path 65.

[Conveyer Path 65]

As depicted in FIG. 2, the conveyer path 65 refers to an area partitioned by an outer guide member 18 and an inner guide member 19, which are arranged in the printer part 11 to face each other. The conveyer path 65 rises from a rear end of the feeder tray 20 and curves upper-frontward in the printer part 11 to extend from the rear side along the recording unit 24 to the ejection tray 21. More specifically, the conveyer path 65 extends through a nipped position in the conveyer roller unit 54, an upper position with respect to the platen 42, and a nipped position in the ejection roller unit 55 to the ejection tray 21. The conveyed flow 16 of the recording sheet 12 to be conveyed in the conveyer path 65 is indicated by a dash-and-dot line shown in FIG. 2.

[Conveyer Roller Unit 54 and Ejection Roller Unit 55]

As depicted in FIG. 2, the conveyer roller unit 54 includes a conveyer roller 60 and a pinch roller 64 and is disposed in an upstream position in the conveyer path 65 with respect to the recording unit 24 along the direction of the conveyed flow 16. Further, in the conveyer path 65, the ejection roller unit 55 includes an ejection roller 62 and a spur 63 and is disposed in a downstream position with respect to the recording unit 24. The recording sheet 12 can be conveyed by the conveyer roller unit 54 and the ejection roller unit 55 along the direction of the conveyed flow 16 in the conveyer path 65.

[Conveyer Roller Unit 54]

The conveyer roller 60 is driven by a conveyer motor 102. The pinch roller 61 is arranged to face the conveyer roller 60 across the conveyer path 65 and is rotated along with rotation of the conveyer roller 60. The conveyer roller 60 and the pinch roller 61 nip the recording sheet 12 in there-between and convey the recording sheet 12 along the conveyed flow 16.

[Ejection Roller Unit 55]

The ejection roller 62 is driven by the conveyer motor 102. The spur 63 is arranged to face the ejection roller 62 across the conveyer path 65 and is rotated along with rotation of the ejection roller 62. The ejection roller 62 and the spur 63 nip the recording sheet 12 in there-between and convey the recording sheet 12 along the conveyed flow 16.

[Registration Sensor 160]

As depicted in FIG. 2, in an upstream position with respect to the conveyer roller unit 54 along the direction of the conveyed flow 16 in the conveyer path 65, a known registration sensor 160 is disposed. When the sheet 12 is positioned at a sensor position where the registration sensor 160 is disposed in the conveyer path 65, the registration sensor 160 outputs low-leveled signals. Meanwhile, when the sheet 12 is not positioned at the sensor position, the registration sensor 160 outputs high-leveled signals.

[Rotary Encoder 170]

Figure 3:
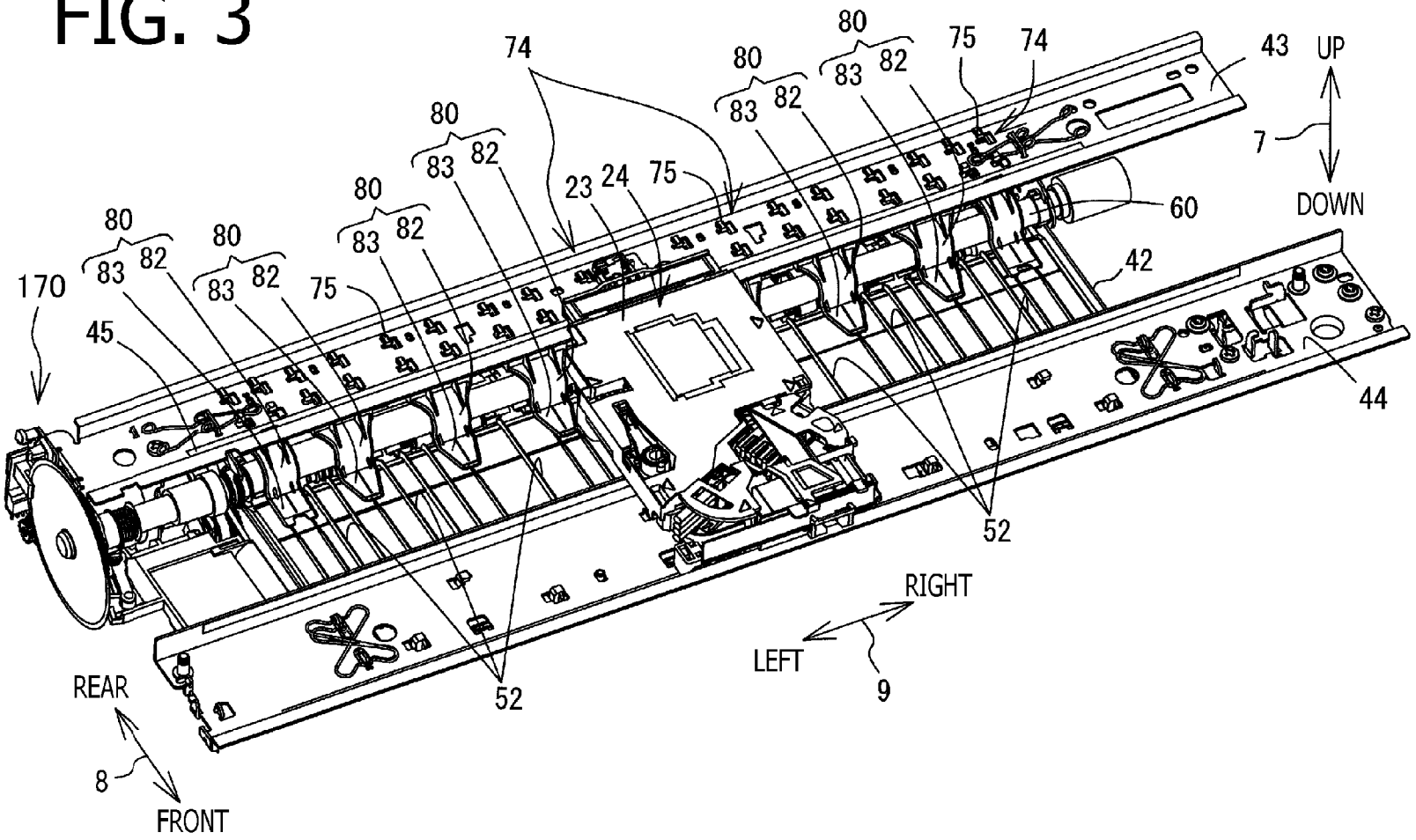
FIG. 3 is a perspective view of a recording unit 24 supported by guide rails 43, 44 in the MFP 10 according to the embodiment of the present invention.
Figure 4:
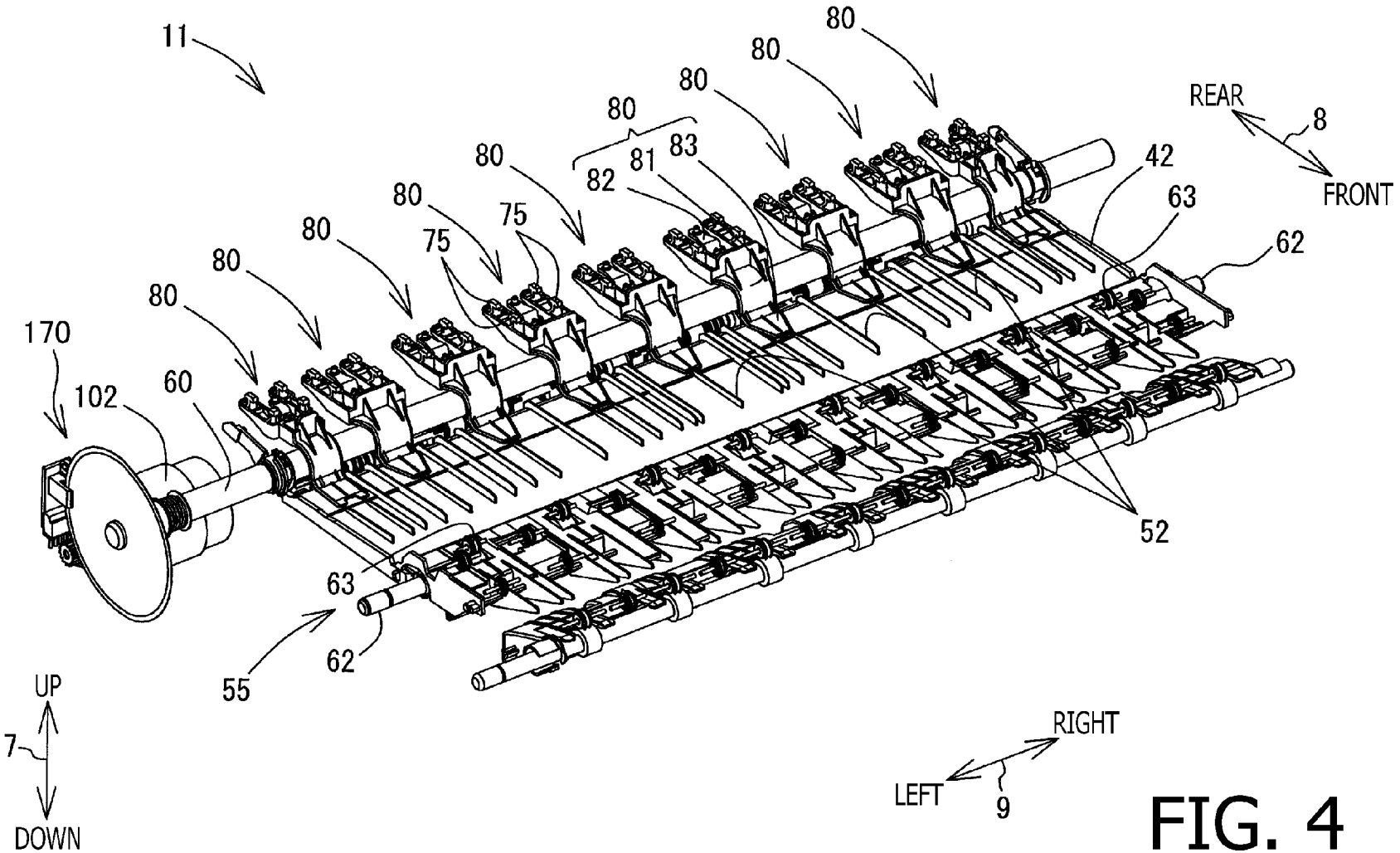
FIG. 4 is a perspective view of contact pieces 80 and a platen 42 in the MFD 10 according to the embodiment of the present invention.

The printer part 11 includes a known rotary encoder 170 (see FIGS. 3 and 4). The rotary encoder 170 generates pulse signals in accordance with rotation of the conveyer roller 60.

[Platen 42]

As depicted in FIG. 2, a platen 42 is arranged in a position between the conveyer roller unit 54 and the ejection roller unit 55 along the direction of the conveyed flow 16. The platen 42 is arranged to vertically face the recording unit 24 to support the recording sheet 12 being conveyed in the conveyer path 65 from below. As depicted in FIG. 5, on an upper plane of the platen 42, a plurality of supporting ribs 52 are formed to protrude upward and extend along the front-rear direction 8. The supporting ribs 52 are formed in positions spaced apart from one another along the widthwise direction 9. Therefore, the recording sheet 12 conveyed in the conveyer path 65 is supported by the platen 42, or, more specifically, by the plurality of ribs 52 formed on the upper plane of the platen 42.

[Recording Unit 24]

As depicted in FIG. 2, the recording unit 24 is arranged in a position where the recording unit 24 faces the platen 42 vertically. The recording unit 24 includes a carriage 23, a recording head 39, and an encoder sensor 38. The carriage 23 is arranged in a position to face the platen 42. The carriage 23 is movable along the widthwise direction 9, which is orthogonal to the direction of the conveyed flow 16.

As depicted in FIG. 3, the carriage 23 is supported by guide rails 43, 44, which are arranged on a rear side and a front side of the platen 42 respectively. The carriage 23 is attached to a known belt-driving mechanism, which is arranged on one of the guide rails 43, 44. The belt-driving mechanism is driven by a carriage motor 103 (see FIG. 6), and thereby, the carriage 23 is movable to reciprocate along the widthwise direction 9. On the guide rail 43, an encoder strip 45, which extends along the widthwise direction 9, is arranged. The encoder strip 45 includes transparent portions and opaque portions, which are arranged alternately along a longitudinal direction thereof. While the carriage 23 is moved along the widthwise direction 9, the encoder sensor 38 detects the transparent portions and the opaque portions when passing them by and generates pulse signals according to the transparency and outputs the generated pulse signals to the controller 130.

As depicted in FIG. 2, the recording head 39 is mounted on the carriage 23. On a bottom plane of the recording head 39, a plurality of nozzles 40 are formed. As ink is supplied to the recording head 39 from an ink cartridge, the recording head 39 discharges minute droplets of the ink through the nozzles 40. As the recording head 39 is moved, the recording head 39 discharges ink droplets onto the recording sheet 12, which is supported by the platen 42. Thus, an image is formed in the ink on the recording sheet 12.

[Contact Pieces 80]

As depicted in FIGS. 2-4, in an upstream position with respect to the recording head 39 along the direction of the conveyed flow 16, a plurality of contact pieces 80 are arranged. The plurality of contact pieces 80 are arranged to be spaced apart from one another along the widthwise direction 9. Each contact piece 80 includes a fixing portion 81, a curved portion 82, and a contact portion 83.

The fixing portion 81 is formed in a shape of a thin plate. The contact piece 80 is fixed to the guide rail 43 at the fixing portion 81. As depicted in FIG. 4, a plurality of (e.g., four) engageable parts 75 are formed to protrude upward from an upper plane of the fixing portion 81. When the engageable parts 75 are engaged with openings 74, which are formed in the guide rail 43, the contact piece 80 is attached to a lower plane of the guide rail 43. As depicted in FIG. 2, the curved portion 82 is formed to extend from the fixing portion 81 and curve lower-frontward toward the downstream of the conveyed flow 16. At the lower-front end of the curved portion 82, the contact portion 83 is formed to protrude frontward.

The contact portion 83 is formed in a shape of a thin plate and is arranged in a position to vertically face the platen 42 along the vertical direction 7. An amount of a gap between a lower surface 84 (see FIG. 5) of the contact portion 83 and the platen 42 is smaller than an amount of a gap between the bottom plane of the recording head 39 and the platen 42 but is maintained to be substantially large to allow the recording sheet 12 to be conveyed in there-between smoothly. Thus, the contact portion 83 is arranged in a position between the carriage 23 and the platen 42 along a direction orthogonal to the direction of the conveyed flow 16 and to the main scanning direction. In other words, the contact portion 83 is arranged in a position between the carriage 23 and the platen 42 along the vertical direction 7.

As depicted in FIG. 5, on the lower surface 84 of the contact portion 83, a contact rib 85 protruding downwardly is formed. While the recording sheet 12 is supported by the platen 42 from below, a lower end of the contact rib 85 contacts an upper surface of the recording sheet 12 of the recording sheet 12. Thus, the recording sheet 12 is pressed downward toward the platen 42 by the contact portion 83 while the image may be formed on the upper surface of the recording sheet 12.

As depicted in FIG. 5, while the plurality of supporting ribs 52 are formed to be spaced apart from one another along the widthwise direction 9, the contact portions 83 of the contact pieces 80 are arranged in between the supporting ribs 52 of the platen 42. Therefore, the supporting ribs 52 protrude toward the carriage 23 at intermediate positions between adjoining contact pieces 80, which are arranged along the widthwise direction 9. In other words, the contact ribs 85 and the supporting ribs 52 are arranged alternately along the widthwise direction 9.

The supporting ribs 52 are, as depicted in FIG. 5, formed to protrude to be higher than the lower ends of the contact ribs 85. More specifically, the supporting ribs 52 contact the recording sheet 12 at positions closer to the recording head 39 than contact positions, at which the contact ribs 85 contact the recording sheet 12. When the recording sheet 12 is in the position between the platen 42 and the contact portions 83, the recording sheet 12 is deformed in a corrugated shape waving up and down alternately along the widthwise direction when viewed from an upstream or a downstream position along the conveyed flow 16.

Thus, the contact pieces 80 and the supporting ribs 52 on the platen 42 serve as a corrugation mechanism, which forms the corrugated shape in the recording sheet 12. In particular, the corrugated shape has peaks 12A of protrusive mountain portions, protruding from a reference position, which will be described later in detail, and bottoms 12B of recessed valley portions, recessed from the reference position. And each of the peaks 12A of protrusive mountain portions and each of the bottoms 12B of recessed valley portions are positioned alternately along the widthwise direction 9. More specifically, the peak 12A refers to a position of boundary point, at which tendency of the amount of the gap between the recording head 39 and the recording sheet 12 along the widthwise direction 9 is turned from decreasing to increasing, in the protrusive mountain portion. When the recording sheet 12 is in between the platen 42 and the contact pieces 80, the positions of the peaks 12A substantially coincide with the positions of the supporting ribs 52. The bottom 12B refers to a position of a boundary point, at which tendency of the amount of the gap between the recording head 39 and the recording sheet 12 along the widthwise direction 9 is turned from increasing to decreasing, in the recessed valley portion. Therefore, when the recording sheet 12 is in between the platen 42 and the contact pieces 80, the positions of the bottoms 12B substantially coincide with the contact ribs 85. The peaks 12A are formed in higher positions with respect to a reference landing position, which will be described later, along the vertical direction 7, and the bottoms 12B are formed in lower positions with respect to the reference landing position along the vertical direction 7. Intermediate portions between the peaks 12A and the bottoms 12B form curves, which can be approximately expressed in a cubic function.

[Controller 130]

As depicted in FIG. 6, the controller 130 includes a CPU (central processing unit) 131, a ROM (read-only memory) 132, a RAM (random access memory) 133, an EEPROM (electrically erasable programmable read-only memory) 134, and an ASIC (application specific integrated circuits) 135, which are connected with one another by internal busses 137. The ROM 132 stores programs to control behaviors of the CPU 131. The RAM 133 is used as a memory area to temporarily store data and signals to be used in cooperation with the programs stored in the ROM 132 and as a work area to process the data. The EEPROM 134 stores data, such as configuration data and flags, which is to be saved even after power to the controller 130 is shut down.

The ASIC 135 is connected with the conveyer motor 102 and the carriage motor 103. The ASIC 135 obtains driving signals to drive the conveyer motor 102 and the carriage motor 103 from the CPU 131 and outputs driving current to the conveyer motor 102 and the carriage motor 103 according to the driving signals. The conveyer motor 102 and the carriage motor 103 are driven in a normal or reverse rotation by the driving current. For example, the controller 130 may control the conveyer motor 102 to rotate the rollers. At the same time, the controller 130 may control the carriage motor 103 to reciprocate the carriage 23. Further, the controller 130 may control the recording head 39 to discharge the ink through the nozzles 40.

The ASIC 135 is electrically connected with the registration sensor 160, the rotary encoder 170, and the encoder sensor 38. Based on the detected signals output from the registration sensor 160 and the pulse signals output from the rotary encoder 170, the controller 130 detects a position of the recording sheet 12 in the conveying path 65. Further, based on the pulse signals obtained from the encoder sensor 38, the controller 130 detects a position of the carriage 23 along the widthwise direction 9.

[Control by the Controller 130]

With reference to FIGS. 7-11, a flow of image recording operation executed by the MFD 10 will be described herein below. The flow described below may be executed by the CPU 131 reading the program from the ROM 132 or may be achieved by hardware circuits mounted on the controller 130. The flow of image recording operation described below and illustrated in FIG. 7 may be repeated by the controller 130 once the MFD 10 is powered on and until the power is shut down.

As the flow starts, in S11, the controller 130 waits for an image recording instruction from the user to be entered. The image recording instruction may be obtained from, but not limited to, an operation panel 17 provided in the MFD 10, for example. For another example, the instruction may be entered from an external device through a communication network. The image recording instruction causes the controller 130 to drive the components including the rollers 25, 60, 62, the carriage 23, and the recording head 39, to record an image on the recording sheet 12. The image recording instruction may include information concerning a moving velocity of the carriage 23, at which the carriage 23 is moved along the widthwise direction 9 as the recording head 39 discharges the ink droplets at the recording sheet 12.

When the controller 130 receives the image recording instruction (S11: YES), in S12, the controller 130 controls the rotation of the feed roller 25 and feed roller 60 so that the recording sheet 12 is fed and conveyed from the feeder tray 20 to a recording-start position. More specifically, the controller 130 controls feeding the recording sheet 12 from the feeder tray 20 by activating the conveyer motor 102 and thereby rotates the feed roller 25, and controls conveying the recording sheet 12 to the recording-start position by activating the conveyer motor 102 and thereby rotates the conveyer roller 60. The recording-start position refers to a position, at which an area for forming an initial part of the image in the recording sheet 12 and the nozzles 40 of the recording head 39 confront each other. The controller 130 may determine that the recording sheet 12 reaches the conveyer roller unit 54 and the recording-start position based on combination of the detected signals output from the registration sensor 160 and the pulse signals output from the rotary encoder 170.

[Determination of Ink-Discharging Timings]

Following S12, in S13-S15, the controller 130 determines timings to discharge the ink droplets toward specific targeted positions on the recording sheet 12. In this regard, it is necessary that the controller 130 controls the nozzles 40 to discharge the ink droplets before the recording head 39 (more specifically, the nozzle 40) reaches straight above positions with respect to the targeted positions in consideration of time lag required for the discharged ink to travel through the gap between the recording head 39 to the recording sheet 12. Further, it is noted that the recording sheet 12 conveyed to the recording-start position in the corrugation mechanism is deformed in the corrugated shape with the peaks 12A and the bottoms 12B as indicated in a solid line shown in FIG. 9. In other words, as the recording head 39 is moved along the main scanning direction, the amount of the gap between the recording head 39 and the recording sheet 12 fluctuates to be larger and smaller alternately. Therefore, it is necessary that the controller 130 adjust the discharging timings of the ink in consideration of the amount of gap fluctuation. For example, the controller 130 adjusts the discharging timing of the ink to be delayed later as the amount of gap is smaller, and meanwhile, the controller 130 adjusts the discharging timing of the ink to be advanced earlier as the amount of gap is larger.

In FIG. 8, the corrugated shape of a dry recording sheet 12, on which no ink is discharged yet, is indicated by a solid line while the corrugated shape of a wet recording sheet 12, on which the ink has been discharged, is indicated by a broken line. In the present embodiment, the corrugated shape of the wet recording sheet 12, which absorbed the discharged ink, is drawn based on an assumption that the peaks 12A of the wet recording sheet 12 tends to shift upward to be closer the recording head 39 and the bottoms 12B tends to shift downward to be farther from the recording head 39. In the corrugated shape of the wet recording sheet 12, the positions of the peaks 12A may not necessarily be at a same level but may be at different levels, and the positions of the bottoms 12*b* may not necessarily be at a same level but may be at different levels. Thus, the controller 130 determines the discharging timings of the ink droplets for each peak 12A and each bottom 12B individually.

[Timing Information Obtaining Step]

Therefore, in S13, the controller 130 executes a timing information obtaining step. In the timing information obtaining step, information concerning timings to discharge the ink toward a targeted position on each peak 12A and each bottom 12B on the recording sheet 12 respectively, is obtained. More specifically, the controller 130 obtains a reference value D0, a peak deviation value Y (m), and a bottom deviation value Y (m+1) for each peak 12A and each bottom 12B from the EEPROM 134. Further, the controller 130 obtains a peak adjusting values $\alpha$ and a bottom adjusting values $\beta$ for each peak 12A and each bottom 12B from the EEPROM 134. The peak adjusting values a and the bottom adjusting values $\beta$ are related to an amount of ink having been discharged previously and are calculated in a discharged ink amount calculating step in S17, which will be described later. The peak adjusting values $\alpha$ and the bottom adjusting values $\beta$ will also be described later in greater detail.

The values to be obtained from the EEPROM 134 may be achieved from experiments and/or simulations and factory-installed in the EEPROM 134 prior to shipping of the MFD 10. If the same peak adjusting values a and bottom adjusting values $\beta$ are commonly shared by different MFDs 10, the peak adjusting values $\alpha$ and the bottom adjusting values $\beta$ related to amounts of discharged ink may be stored in the ROM 132. In the following description, the reference value D0, the peak deviation values Y (m), the bottom deviation values Y (m+1), the peak adjusting values $\alpha$, and the bottom adjusting values $\beta$ will be explained.

[Reference Value D0]

The reference value D0 indicates a reference timing for the ink to be discharged to land on a reference landing position Ls on the recording sheet 12. More specifically, the reference value D0 indicates a time period, which is required for the ink discharged from the nozzle 40 to land on a reference landing position Ls. The reference landing position Ls is set in a center position 12C between a mutually adjoining peak 12A and bottom 12B (i.e., a level of the recording sheet 12 when amplitude is zero) along the vertical direction 7, i.e., a direction along which the recording head 39 and the recording sheet 12 face each other. Meanwhile, the reference value D0 also corresponds to a time period, which is required by the carriage 23 (more specifically, the recording head 39) to move from a reference discharging position Es to a position straight above the reference landing position Ls. Therefore, when the moving velocity of the carriage 23 is expressed by "V", a distance between the reference discharging position Es and the reference landing position Ls along the widthwise direction 9 is expressed as D0 *V. In the following description, when the position of the carriage 23 is referred to, it may be interpreted as a position of the recording head 39.

For example, when the carriage 23 moving rightward reaches the reference discharging position Es and discharges the ink from the recording head 39 thereat, the ink lands on the reference landing position Ls on the recording sheet 12 after D0 second, i.e., after the time period indicated by the reference value D0. Meanwhile, the carriage 23 reaches the position straight above the reference landing position Ls D0 second after the discharge of the ink at the reference discharging position Es. In other words, in order for the discharged ink to land on the reference landing position Ls, the ink should be discharged D0 second before the carriage 23 reaches the position straight above the reference landing position Ls, i.e., when the carriage 23 is at the reference discharging position Es. Thus, the reference value D0 specifies the discharging timing for the ink to be discharged and land on the intermediate position C (i.e., on the reference landing position Es).

The above-mentioned center position 12C may not necessarily be limited to the center position between the mutually adjoining peak 12A and bottom 12B. For example, the center position 12C may be set at an average level between one of the peaks 12A closest to the recording head 39 along the vertical direction 7 and one of the bottoms 12B farthest from the recording head 39 along the vertical direction 7. For another example, the center position 12C may be set at an average level between an average level among levels of the plurality of peaks 12A and an average level among levels of the plurality of bottoms 12B along the vertical direction 7.

The reference value D0 is commonly applied to every targeted position on the recording sheet 12. Meanwhile, the reference value D0 may not necessarily be limited to the example described above but may include, for example, a plurality of reference values. For example, a first reference value, which is used when the discharging timings for the ink to be discharged to land on the peaks 12A are determined, and a second reference value, which is used when the discharging timings for the ink to be discharged to land on the bottoms 12B are determined, may be included and stored in the EEPROM 134. In such a case, the first reference value may be an average value for the discharging timings to discharge the ink at each one of the peaks 12A, and the second reference value may be an average value for the discharging timings to discharge the ink at each one of the bottoms 12B.

[Peak Deviation Value Y(m)]

An example, when the recording head 39 discharges the ink at the peak 12A on the dry recording sheet 12, indicated by the solid line in FIG. 8, will be described. While the carriage 23 is moving rightward along the widthwise direction 9, the recording head 39 targets the ink to land on the peak 12A and discharges the ink D0 second before the carriage 23 reaches the position straight above the peak 12A at the reference discharging position Es. In this regard, however, the ink lands on a backward (leftward) position with respect to the peak 12A in the moving direction (rightward) of the carriage 23 along the widthwise direction 9, at a landing position LA1. Thus, a distance a1 between the reference discharging position Es and the landing position LA1 along the widthwise direction 9 is smaller than a distance a (i.e., D0*V) between the reference discharging position Es and the targeted peak 12A along the widthwise direction 9 (distance a1<distance a). A deviated amount between the distance a1 and the distance a is represented by the peak deviation value Y(m).

Therefore, it is necessary that the recording head 39 discharges the ink targeted at the peak 12A at a peak-targeted discharging position Ea (see FIG. 9), which is displaced from the reference discharging position Es backward along the moving direction of the carriage 23 for the amount indicated by the peak deviated amount Y(m). Thus, the peak deviation value Y(m) indicates the distance between the reference discharging position Es, at which the recording head 39 should discharge the ink at the center position 12C, and the peak-targeted discharging position Ea, at which the recording head 39 should discharge the ink at the peak 12A, along the widthwise direction 9. Namely, the peak deviation value Y(m), which specifies the discharging timing for the ink to be discharged to land on the peak 12A, is obtained by correctly delaying the discharging timing for the ink to be discharged at the center position 12C, which is specified by the reference value D0. In other words, the peak deviation value Y(m), which is obtained by correcting the reference discharging position Es, provides the peak-targeted discharging position Ea.

[Bottom Deviation Value Y(m+1)]

An example, when the recording head 39 discharges the ink at the bottom 12B on the dry recording sheet 12, indicated by the solid line in FIG. 8, will be described. While the carriage 23 is moving rightward along the widthwise direction 9, the recording head 39 targets the ink to land on the bottom 12B and discharges the ink D0 second before the carriage 23 reaches the position straight above the bottom 12B at the reference discharging position Es. In this regard, however, the ink lands on a forward (rightward) position with respect to the bottom 12B in the moving direction (rightward) of the carriage 23 along the widthwise direction 9, at a landing position LB1. Thus, a distance b1 between the reference discharging position Es and the landing position LB1 along the widthwise direction 9 is greater than a distance b (i.e., D0*V) between the reference discharging position Es and the targeted bottom 12B along the widthwise direction 9 (distance b1>distance b). A deviated amount between the distance b1 and the distance b is represented by the bottom deviation value Y(m+1).

Therefore, it is necessary that the recording head 39 discharges the ink targeted at the bottom 12B at a bottom-targeted discharging position Eb (see FIG. 9), which is displaced from the reference discharging position Es forward along the moving direction of the carriage 23 for the amount indicated by the bottom deviated amount Y(m+1). Thus, the bottom deviation value Y(m+1) indicates the distance between the reference discharging position Es, at which the recording head 39 should discharge the ink at the center position 12C, and the bottom-targeted discharging position Eb, at which the recording head 39 should discharge the ink at the bottom 12B, along the widthwise direction 9. Namely, the bottom deviation value Y(m+1), which specifies the discharging timing for the ink to be discharged to land on the bottom 12B, is obtained by correctly advancing the discharging timing for the ink to be discharged to at the center position 12C, which is specified by the reference value D0. In other words, the bottom deviation value Y(m+1), which is obtained by correcting the reference discharging position Es, provides the bottom-targeted discharging position Eb.

[Correction by Peak and Bottom Deviation Values]

Therefore, a length of the time required for the carriage 23 to move the distance corresponding to the peak deviation value Y(m) or the bottom deviation value Y(m+1) is obtained by dividing the peak deviation value Y(m) or the bottom deviation value Y(m+1) by the moving velocity V of the carriage 23. Namely, the discharging timing targeted at the peak 12A is expressed as D0+Y(m)/V, and the discharging timing targeted at the bottom 12B is expressed as D0+Y(m+1)/V. Thus, by shifting the discharging timing targeted at the peak 12A or the bottom 12B from the reference value D0, the ink is discharged to land on the targeted peak 12A or bottom 12B. Having mentioned that, however, in the present embodiment, the peak deviation value Y(m) or the bottom deviation value Y(m+1) is divided by doubled V (i.e., 2V), in consideration of results obtained from experiments and simulations. In other words, in the present embodiment, the discharging timing for the peak 12A is expressed as D0+Y(m)/2V, and the discharging timing for the bottom 12B is expressed as D0+Y(m+1)/2V.

Thus, a discharging timing for the peak 12A on the dry recording sheet 12 is obtained by dividing the peak deviation value Y(m) by the moving velocity 2V (or V) and adding the reference value D0. According to the correction, as depicted in FIG. 9, the discharging timing for the peak 12A (D0+Y(m)/2V) is delayed to be later than the discharging timing specified by the reference value D0. Thus, the discharging timing for the ink to be discharged to land on the targeted peak 12A (i.e., the peak-targeted discharging position Ea) is specified by the combination of the reference value D0, the peak deviation value Y(m), and the moving velocity V of the carriage 23.

Meanwhile, the discharging timing for the bottom 12B on the dry recording sheet 12 is obtained by dividing the bottom deviation value Y(m+1) by the moving velocity 2V (or V) and adding the reference value D0. According to the correction, as depicted in FIG. 9, the discharging timing for the bottom 12B (D0+Y(m+1)/2V) is advanced to be earlier than the discharging timing specified by the reference value D0. Thus, the discharging timing for the ink to be discharged to land on the targeted bottom 12B (i.e., the bottom-targeted discharging position Eb) is specified by the combination of the reference value D0, the bottom deviation value Y(m+1), and the moving velocity V of the carriage 23.

Thus, values x specifying the discharging timings for the targeted peak 12A and the targeted bottom 12B is represented in an expression x=D0+Y(m)/2V and an expression x=D0+Y(m+1)/2V respectively. In this regard, the value x indicates that the ink is to be discharged x second(s) before the carriage 23 reaches the position straight above the targeted position. Therefore, as the greater value x is provided, the discharging timing is advanced to be earlier. Meanwhile, as the smaller value x is provided, the discharging timing is delayed to be later. Accordingly, when the reference value D0 being a positive value is provided, Y(m)/2V being a negative value, of which absolute value is smaller than the reference value D0, and Y(m+1)/2V being a positive value are achieved.

Meanwhile, in the present embodiment, as depicted in FIG. 4, the contact pieces 80 are arranged at nine (9) positions along the widthwise direction 9 to be spaced apart from one another. As mentioned above, the bottoms 12B of the recording sheet 12 are formed in the positions where the contact ribs 85 of the contact pieces 80 are arranged. Therefore, nine (9) bottoms 12B are formed in the recording sheet 12. In this regard, in order to avoid widthwise ends of the recording sheet 12 from being contacted by the recording head 39, the recording sheet 12 is deformed to have the widthwise ends thereof to form the bottoms 12B, to be apart from the recording head 39. Therefore, while each peak 12A is formed in between mutually adjoining two bottoms 12B, eight (8) peaks 12A are formed in the recording sheet 12.

Thus, with the eight peaks 12A and the nine bottoms 12B formed in the recording sheet 12, the EEPROM 134 stores the reference value D0, eight peak deviation values Y(2), Y(4), Y(6), Y(8), Y(10), Y(12), Y(14), Y(16), which correspond to one of the eight peaks 12A respectively, and nine bottom deviation values Y(1), Y(3), Y(5), Y(7), Y(9), Y(11), Y(13), Y(15), Y(17), which correspond to one of the nine bottoms 12B respectively, therein. Further, the EEPROM 134 stores the peak adjusting values α and the bottom adjusting values β, which are associated with amounts of the ink respectively therein. In the present embodiment, when the peak deviation value for one of the peaks 12A is represented by a sign Y(m), the bottom deviation value for one of the bottoms 12B formed on a right-hand side neighboring position with respect to the one of the peaks 12A is represented by a sign Y(m+1).

[Peak Adjusting Value α]

When the recording sheet 12 absorbs a large amount of discharged ink, the recording sheet 12 changes its corrugated shape from the shape indicated by the solid line in FIG. 8 to the shape indicated by the broken line in FIG. 8. More specifically, the vertical positions of the peaks 12A in the wet recording sheet 12 shift upward to be higher along the vertical direction 7 than the positions of the peaks 12A in the dry recording sheet 12. Therefore, if the recording head 39 targets the ink to land on the peak 12A in the dry recording sheet 12 but discharges the ink onto the wet recording sheet 12 at the reference discharging position Es, the ink lands on a landing position LA2, which is a backward position with respect to the landing position LA1 in the moving (rightward) direction of the carriage 23 along the widthwise direction 9. Thus, a distance a2 between the reference discharging position Es and the landing position LA2 in the wet recording sheet along the widthwise direction 9 is smaller than the distance a1 between the reference discharging position Es and the landing position LA1 in the dry recording sheet 12 along the widthwise direction 9 (distance a2<distance a1).

Accordingly, it is necessary that the recording head 39 discharges the ink at the peak 12A in the wet recording sheet 12 at a corrected peak-targeted discharging position Ea' (see FIG. 9), which is displaced from the reference discharging position Es backward along the moving direction of the carriage 23. In order to correct the peak-targeted discharging position Ea into the corrected peak-targeted discharging position Ea', the peak adjusting value α is applied. The peak adjusting value α adjusts the absolute value in the peak deviation value Y(m) so that the absolute value in the peak deviation value Y(m) is increased to be greater as the amount of the ink discharged at the recording sheet 12 is greater. In other words, with the peak adjusting value α, the greater the amount of the ink discharged at the recording sheet 12 is, the later the discharging timing is delayed to be.

[Bottom Adjusting Value β]

When the recording sheet 12 absorbs a large amount of discharged ink, the recording sheet 12 changes its corrugated shapes from the shape indicated by the solid line in FIG. 8 to the shape indicated by the broken line in FIG. 8. More specifically, the vertical positions of the bottoms 12B in the wet recording sheet 12 shift downward to be lower along the vertical direction 7 than the positions of the bottoms 12B in the dry recording sheet 12. Therefore, if the recording head 39 targets the ink to land on the bottom 12B in the dry recording sheet 12 and discharges the ink onto the wet recording sheet 12 at the reference discharging position Es, the ink lands on a landing position LB2, which is a forward position along the widthwise direction 9 with respect to the landing position LB 1 along the moving (rightward) direction of the carriage 23 along the widthwise direction 9. Thus, a distance b2 between the reference discharging position Es and the landing position LB2 in the wet recording sheet 12 along the widthwise direction 9 is greater than the distance b1 between the reference discharging position Es and the landing position LB1 in the dry recording sheet 12 along the widthwise direction 9 (distance b1<distance b2).

Accordingly, it is necessary that the recording head 39 discharges the ink at the bottom 12B in the wet recording sheet 12 at a corrected bottom-targeted discharging position Eb' (see FIG. 9), which is displaced from the reference discharging position Es forward along the moving direction of the carriage 23. In order to correct the bottom-targeted discharging position Eb into the corrected bottom-targeted discharging position Eb', the bottom adjusting value β is applied. The bottom adjusting value β adjusts the absolute value in the bottom deviation value Y(m+1) so that the absolute value in the bottom deviation value Y(m+1) is increased to be greater as the amount of the ink discharged at the recording sheet 12 is greater. In other words, with the bottom adjusting value β, the greater the amount of the ink discharged at the recording sheet 12 is, the earlier the discharging timing is advanced to be.

Therefore, as depicted in FIG. 10, the EEPROM 134 stores the peak adjusting values α and the bottom adjusting values β in association with the amounts of discharged ink, which are obtained in the discharged ink amount calculating step in S17. The discharged ink amount calculating step will be described later in detail. In this regard, the peak adjusting values α and the bottom adjusting values β are values, which are increased to be greater as the greater amount of discharged ink is provided and are greater than or equal to 1. In FIG. 10, within the amounts of discharged ink ranging from 0 to V5, 0 is the smallest and V5 is the greatest ($0<V1<V2<V3<V4<V5$). Within the peak adjusting values α, 1 is the smallest and α5 is the greatest ($1<\alpha1<\alpha2<\alpha3<\alpha4<\alpha5$). Within the bottom adjusting values β, 1 is the smallest and β5 is the greatest ($1<\beta1<\beta2<\beta3<\beta4<\beta5$).

Referring back to FIG. 7, the description of the image recording operation to be executed by the controller 130 in the MFD 10 will be continued. Following S12, in which the recording sheet 12 reaches the recording-start position, the flow proceeds to S13. In this regard, at the time when the recording sheet 12 reaches the recording-start position, the amount of discharged ink is zero (0). In S13, in the timing information obtaining step, the controller 130 obtains the reference value D0, a plurality of peak deviation values Y (m) for the peaks 12A, and a plurality of bottom deviation values Y (m+1) for the bottoms 12B from the EEPROM 134. Further, the controller 130 obtains the peak adjusting value α for each peak 12A related to the amount of discharged ink being 0 and the bottom adjusting value β for each bottom 12B related to the amount of discharged ink being 0 from the EEPROM 134. In this flow, the controller 130 obtains the peak adjusting value α being 1 and the bottom adjusting value β being 1 for the amount 0. With these obtained values, the discharging timings to discharge the ink at each peak 12A and bottom 12B on the dry recording sheet 12 are obtained. Correction with the peak deviation value Y(m) and the bottom deviation value Y(m+1) will be described later in detail.

[Discharging Timing Correcting Step]

Next, the controller 130 executes a discharging timing correcting step (S14). In the discharging timing correcting step, the discharging timings to discharge the ink at the peaks 12A and the bottoms 12B in the dry recording sheet 12 obtained in S13 are corrected according to the change in the corrugated shape of the recording sheet 12, i.e., according to the amount of discharged ink (i.e., wetness) on the recording sheet 12.

In S14, the controller 130 adjusts the peak deviation value Y(m) and the bottom deviation value Y(m+1) for each peak 12A and bottom 12B by multiplying the peak deviation value Y(m) by the peak adjusting value α and the bottom deviation value Y(m+1) by the bottom adjusting value β. Thereafter, the controller 130 divides the adjusted peak deviation value αY(m) for each peak 12A and the adjusted bottom deviation value βY(m+1) for each bottom 12B by the moving velocity 2V of the carriage 23 respectively. Thus, a divided value αY(m)/2V for each peak 12A and a divided value βY(m+1)/2V for each bottom 12B are obtained. Further, the controller 130 adds the reference value D0 to the divided values αY(m)/2V and βY(m+1)/2V respectively to correct the discharging timings for each peak 12A and the bottom 12B.

Thus, the discharging timing to discharge the ink at the peak 12A in the wet recording sheet 12, i.e., the corrected peak-targeted discharging position Ea', expressed as D0+αY (m)/2V, is obtained. In other words, the combination of the reference value D0, the peak deviation value Y(m), the peak adjusting value α, and the moving velocity V of the carriage 23 provide the corrected peak-targeted discharging position Ea'. Similarly, the discharging timing to discharge the ink at the bottom 12B in the wet recording sheet 12, i.e., the corrected bottom-targeted discharging position Eb', expressed as D0+αY(m+1)/2V, is obtained. In other words, the combination of the reference value D0, the bottom deviation value Y(m+1), the bottom adjusting value β, and the moving velocity V of the carriage 23 provide the corrected bottom-targeted discharging position Eb'.

In the present embodiment, hereinafter, the discharging timings obtained in the discharging timing correcting step will be referred to as "corrected discharging timings." In the discharging timing correcting step executed for the first time for the image recording instruction, the peak adjusting values α for all the peaks 12A in the dry recording sheet 12 are 1, and the bottom adjusting values β for all the bottoms 12B in the dry recording sheet 12 are 1. Therefore, the peak deviation values Y(m) and the bottom deviation values Y(m+1) remain unchanged. In other words, the discharging timings for the peaks 12A and the bottoms 12B are not changed in the initial execution of the discharging timing correcting step. Accordingly, the corrected discharging timing for each peak 12A being D0+Y(m)/2V and the corrected discharging timing for each bottom 12B being D0+Y(m+1)/2V are provided.

[Discharging Timing Calculating Step]

Following S14, the flow proceeds to S15. In S15, the controller 130 executes a discharging timing calculating step. In the discharging timing calculating step, discharging timings to discharge the ink at transitional positions between each peak 12A and bottom 12B are obtained. The discharging timings for the transitional positions are obtained based on the peak deviation value Y(m), which is a peak deviation value Y(m) for a peak 12A closest to the transitional position along the widthwise direction 9, and the bottom deviation value Y(m+1), which is a bottom deviation value Y(m+1) for a bottom 12B closest to the transitional position along the widthwise direction 9. Further, an interpolating expression 1 described below and the reference value D0 are used for the calculation.

More specifically, the controller 130 fills the interpolating expression 1 with values (x, c) which identify the transitional position, the peak deviation value Y(m) of the peak 12A closest to the transitional position, and the bottom deviation value Y(m+1) of the bottom 12B closest to the transitional position. Thereby, a deviation value y', which indicates a deviated amount between the targeted transitional position and a landing position for the ink discharged D0 second(s) before the carriage 23 reaches a position straight above the targeted transitional position along the widthwise direction 9, is calculated. Thereafter, the controller 130 fills expression 2 described below with the deviation value y' and the reference value D0. Thus, the discharging timing to discharge the ink toward the targeted transitional position is obtained. The controller 130 repeats the calculations for all the transitional positions in between each peak 12A and bottom 12B.

$$y' = -\frac{1}{L^3}(Y_{(m+1)} - Y_{(m)})(x + c - X_{(m)})^2\{2(x + c - X_{(m)}) - 3L\} + Y_{(m)} \quad \text{[Expression 1]}$$

$$D_{(x)} = \frac{y'}{2V} + D_0 \quad \text{[Expression 2]}$$

The value x in the expression 1 identifies a position of the carriage 23 and is determined based on the pulse signals from the encoder sensor 38. The value c in the expression 1 indicates a distance between a nozzle 40, of which discharging timing is being calculated, and a widthwise center of the recording head 39. The value X(m) in the expression 1 indicates the positions of the peak 12A and the bottom 12B closest to the transitional position and is determined based on the pulse signals from the encoder sensor 38. The value L in the expression 1 indicates a distance between the peak 12A and the bottom 12B closest to the transitional position and is expressed as L=X(m+1)−X(m). The value V in the expression 2 indicates the moving velocity of the carriage 23 obtained in S11.

Next, in S16, the controller 130 executes an image recording step, in which an image is recorded in a recordable range (see FIG. 11) of the recording sheet 12. The recordable range spreads along the direction of the conveyed flow 16 on the recording sheet 12 and extends along a direction orthogonal to the conveyed flow 16, i.e., along the widthwise direction 9. In other words, the recordable range is a part of the recording sheet 12 which vertically faces the recording head 39 while the carriage 23 is moved along the widthwise direction 9. The controller 130 manipulates the recording head 39 to discharge the ink from the nozzle 40 while the carriage 23 is moved in one direction (e.g., rightward in FIG. 9) along the widthwise direction 9, at the discharging timing obtained in the timing information obtaining step in S13 and the discharging timing calculating step in S15.

[Discharged Ink Amount Calculating Step]

Following S16, in S17, the controller 130 executes a discharged ink amount calculating step. In particular, the amount of ink discharged from the recording head 39 at the recordable range in the recording step (S16) is obtained. More specifically, the controller 130 divides the recording sheet 12 into gridded unit areas, as indicated by broken lines in FIG. 11, and calculates an amount of the ink discharged at each unit area. Each unit area does not include the adjoining peak 12A and the bottom 12B at a time, but each unit area includes solely one of the adjoining peak 12A and the bottom 12B. In the example shown in FIG. 11, seventeen (17) unit areas are arranged in line along the widthwise direction 9. In this regard, the quantity of the unit areas in line (17) is a sum of the quantity of the peaks 12A (i.e., 8) and the quantity of the bottoms 12B (i.e., 9). Meanwhile, a dimension of each unit area spreading along the direction of the conveyed flow 16 is smaller than or equal to the dimension of the recordable range along the direction of the conveyed flow 16. In the present embodiment, each recordable range contains three (3) unit areas aligned along the direction of the conveyed flow 16; however, a quantity of the unit areas to be contained in the recordable range may not necessarily be limited, but the recordable range may contain more or less quantity of unit areas.

In memory areas reserved in the RAM 133, each of which is assigned to one of the unit areas including one of the peaks 12A and the bottoms 12B, the controller 130 writes an amount of the ink discharged in a preceding image recording step (S 16) at the unit area in the recording sheet 12. If the controller 130 repeats the image recording behavior of the recording head 39 to the unit area for a plurality of times, the amount of ink discharged for the unit area written in the memory area is updated for each time. Thus, an accumulated and latest amount of the ink discharged for the same unit area is stored in the memory area in the RAM 133.

Next, in S18, the controller 130 judges whether an entire image for the image recording instruction is completely recorded on the recording sheet 12. If image recording is not completed (S18: NO), in S19, the controller 130 transitively conveys the recording sheet 12 along the conveyed flow 16 for a predetermined linefeed amount. In particular, the controller 130 manipulates the conveyer motor 102 to rotate for a predetermined amount so that at least one of the conveyer roller unit 54 and the ejection roller unit 55 is driven to convey the recording sheet 12 for the predetermined linefeed amount. Accordingly, a next recordable range in the recording sheet 12 is placed to face the recording head 39.

Thus, steps S13-S19 may be repeated for a plurality of times. When steps S13-S15 are repeated, before repeating the image recording step in S16, the discharging timings to discharge the ink in the next recordable range are adjusted in consideration of the amount of the ink discharged in the previous recordable range.

With reference to FIG. 11, an example of the process to determine the discharging timings in consideration of the ink discharged in preceding image recording steps will be described below. In the example shown in FIG. 11, a part of the image has been recorded on the recording sheet 12 containing the unit areas in the preceding image recording steps (S16). In the example shown in FIG. 11, the unit areas with the ink discharged thereat are indicated by hatchings. It is noted that hatching patterns drawn over the unit areas differ depending on the amounts of the ink discharged at the unit areas. In particular, a dense hatching pattern (i.e., position 12D in FIG. 11) indicates the ink amount V5 discharged at the unit area, while a gross hatching pattern (i.e., position 12E in FIG. 11) indicates the ink amount V2 discharged in the unit area. The unit area having no hatching (i.e., position 12F in FIG. 11) indicates that no ink has been discharged in the unit area.

After S19, the flow returns to S13, and the controller 130 executes the above-mentioned timing information obtaining step (S13). In particular, the controller 130 obtains the reference value D0, eight (8) peak deviation values Y (m), and nine (9) bottom deviation values Y (m+1) for the peaks 12A and the bottoms 12B contained in the unit areas in a currently recording recordable range from the EEPROM 134. Further, the controller 130 obtains the peak adjusting values a for the peak deviation values Y (m) and the bottom adjusting values for β the bottom deviation values Y (m+1) respectively from the EEPROM 134. Thus, the controller 130 obtains eight (8) peak adjusting values α and nine (9) bottom adjusting values β for the current recordable range from the EEPROM 134.

More specifically, the controller 130 determines the peak adjusting value α or the bottom adjusting value β for each unit area contained in the current recordable range in consideration of an amount of the ink having been discharged in an adjoining unit area, which adjoins the current recordable range at a downstream position along the direction of conveyed flow 16, from the EEPROM 134. According to the example shown in FIG. 11, the controller 130 obtains the peak adjusting values α and the bottom adjusting values β associated with the amounts of the ink discharged at adjoining unit areas at the position 12G, which adjoin the current recordable range at a downstream position along the direction of conveyed flow 16. In particular, as to the peak adjusting value α with respect to the peak deviation value Y(2) in the current recordable range, for example, the controller 130 refers to an amount of the ink discharged in the adjoining unit area at the downstream position 12G along the direction of conveyed flow 16. In this case, the amount V5 is referred to. Therefore, the peak adjusting value α5 associated with the amount V5 (see FIG. 10) is obtained. Similarly, the bottom adjusting value β5 associated with the amount V5 of the ink discharged at the adjoining unit areas at the downstream positions 12G with respect to the bottom deviation values Y(1), Y(3) is obtained. Further, the peak adjusting value α2 associated with the amount V2 of the ink discharged at the adjoining unit areas at the downstream positions 12G with respect to the peak deviation values Y(4), Y(6) is obtained, and the bottom adjusting value β2 associated with the amount V2 of the ink discharged at the adjoining unit areas at the downstream positions 12G with respect to the bottom deviation values Y(5), Y(7) is obtained. Furthermore, the peak adjusting value 1 associated with the amount zero (0) of the ink discharged at the adjoin unit areas at the downstream positions 12G with respect to the peak deviation values Y(8), Y(10), Y(12), Y(14), Y(16) is obtained, and the bottom adjusting value 1 associated with the amount zero (0) of the ink discharged at the adjoining unit areas at the downstream positions 12G with respect to the bottom deviation values Y(9), Y(11), Y(13), Y(15), Y(17) is obtained.

The method to determine the peak adjusting values a for the peak deviation values Y(8), Y(10), Y(12), Y(14), Y(16) and the bottom adjusting values β for the bottom deviation values Y(9), Y(11), Y(13), Y(15), Y(17) may not necessarily be limited to the one described above. For example, the peak adjusting value α or the bottom adjusting value β for each unit area may be determined based on the amount of the ink having been discharged previously (most recently) in a unit area among the downstream unit areas in the downstream positions with respect to the current recordable range along the direction of the conveyed flow 16. In the example shown in FIG. 11, as to the peak adjusting value α for the peak deviation value Y(8), the amount V2 in the unit area in a downstream position 12H may be referred to, and the peak adjusting value α2 may be obtained. Similarly, as to the peak adjusting value α for the peak deviation values Y(10), Y(12), Y(14), Y(16), based on the amount V5 of the ink discharged in the unit areas in the downstream positions 12H, the peak adjusting value α5 may be obtained. Further, as to the bottom adjusting value β for the bottom deviation value Y(9), based on the amount V2 of the ink discharged in the unit area in the downstream position 12H, the bottom adjusting value β2 may be obtained, and as to the bottom adjusting values β for the bottom deviation values Y(11), Y(13), Y(15), Y(17), based on the amount V5 of the ink discharged in the unit areas in the downstream positions 12H, the bottom adjusting values β5 may be obtained.

If the peak adjusting values α and the bottom adjusting values β are determined in the latter method described above, i.e., based on the amount of the most recently discharged ink at the position 12H, it is noted, when the unit area in the current recordable range is substantially apart from the unit area in the downstream position 12H having the most recently discharged ink, that the corrugated shape in the current recordable range in the recording sheet 12 may not necessarily be affected by the wetness of the most recently discharged ink at the downstream position 12H. Rather, the corrugated shape in the current recordable range in the recording sheet 12 may be more closely affected by other closer unit areas, such as the unit areas in the downstream positions 12G. Therefore, it may be preferable that, the longer a distance between the unit area in the current recordable range and the unit area to be referred to with the most recently discharged ink along the direction of conveyed flow 16 becomes, the less the peak adjusting values Y(m) and the bottom adjusting values Y(m+1) are influenced by the peak adjusting values α and the bottom adjusting values β of the farther positions.

Next, in S14, the controller 130 executes the discharging timing correcting step. In particular, the controller 130 multiplies the peak deviation value Y(m) obtained in S13 by the peak adjusting value α obtained in S13 for each peak 12A and the bottom deviation value Y(m+1) obtained in S13 by the bottom adjusting value β obtained in S13 for each bottom 12B respectively. With the multiplication, the peak deviation values Y(2), Y(4), Y(6) and the bottom deviation values Y(1), Y(3), Y(5), Y(7) are adjusted to be amplified with the absolute values thereof being greater. In other words, according to the adjusted peak deviation values Y(2), Y(4), Y(6), the discharging timings for the peaks 12A are delayed to be later than the unadjusted discharging timings. On the other hand, according to the adjusted bottom deviation values Y(1), Y(3), Y(5), Y(7), the discharging timings for the bottoms 12B are advanced to be earlier than the unadjusted discharging timings. Meanwhile, the peak deviation values Y(8), Y(10), Y(12), Y(14), Y(16) and the bottom deviation values Y(9), Y(11), Y(13), Y(15), Y(17) remain unadjusted. Thereafter, the controller 130 adds the reference value D0 to each of the adjusted peak deviation values αY(m) and the bottom deviation values βY(m+1). Thus, the corrected discharging timings for the peaks 12A and the bottoms 12B are obtained.

As a result, as shown in FIG. 9, according to the corrected discharging timings (i.e., D0+αY(m)/2V) for the peaks 12A, the ink is discharged at delayed timings, which are later than the discharging timing (D0+Y(m)/2V) of the ink to be discharged at the peaks 12A in the dry recording sheet 12. Meanwhile, according to the corrected discharging timings (i.e., D0+βY(m+1)/2V) for the bottoms 12B, the ink is discharged at advanced timings, which are earlier than the discharging timing (D0+Y(m+1)/2V) of the ink to be discharged at the bottoms 12B in the dry recording sheet 12.

Further, the greater amount of the discharged ink is provided, the greater the peak adjusting values αand the bottom adjusting values β become. Therefore, delayed amounts of the corrected discharging timings for the ink to be discharged at the peaks 12A are amplified, and the corrected discharging timings are delayed to be even later with respect to the discharging timings specified by the reference value D0. In other words, the greater the amount of the discharged ink is, the later the corrected discharging timings for the peaks 12A are delayed to be with respect to the discharging timings specified by the reference value D0. Meanwhile, advanced amounts of the corrected discharging timings for the ink to be discharged at the bottoms 12B are amplified, and the corrected discharging timings are advanced to be even earlier with respect to the discharging timings designated by the reference value D0. In other words, the greater the amount of the discharged ink is, the earlier the corrected discharging timings for the bottoms 12B are advanced to be with respect to the discharging timings designated by the reference value V10.

Following S14, in S15, the controller 130 executes the discharging timing calculating step. In particular, the discharging timings to discharge the ink toward the transitional positions between the peaks 12A and the bottoms 12B are obtained based on the adjusted peak deviation values αY(m) and the adjusted bottom deviation values βY(m+1) obtained in the discharging timing correcting step in S14. In this regard, the controller 130 replaces the value Y(m) and the value Y(m+1) in the expression 1 with αY(m) and βY(m+1) respectively. Following S14, the steps S15-S18 described above are similarly executed, and detailed description for those are herein omitted.

Following S18, the controller 130 repeats S13-19 until the entire image is completely recorded on the recording sheet 12. When the entire image is completely recorded on the recording sheet 12 (S18: YES), in S20, the controller 130 controls the rotation of the feed roller 25 and feed roller 60 so that recording sheet 12 is ejected in the ejection tray 21. In particular, the controller 130 manipulates the conveyer motor 102 to rotate for a predetermined amount. Thus, the recording sheet 12 is conveyed to the ejection tray 20 by the ejection roller unit 55 and ejected from the MFD 1.

[Usability and Modifications]

According to the embodiment described above, the discharging timings to discharge the ink is adjusted in consideration of the nature of the recording sheet 12, which tends to change positions thereof in accordance with the amount of the ink having been discharged, so that the ink can be discharged in the more preferable timings. The discharging timings are adjusted for each peak 12A and bottom 12B formed in the recording sheet 12; therefore, the discharging timings can be suitably adjusted in accordance with the changed position of the recording sheet 12. For example, it is noted that, while an amount of the downward shift of the bottom 12B is restricted by the platen 70, an amount of the upward shift of the peak 12A tends to be greater than the shifted amount of the bottom 12B. Therefore, it may be preferable that the peak adjusting value α may be set to be greater than the bottom adjusting value β with respect to the same amount of the discharged ink.

According to the embodiment described above, the discharging timings for other targeted positions than the peaks 12A and the bottoms 12B, i.e., the targeted positions for the transient positions between the peaks 12A and the bottoms 12B, are calculated in the discharging timing calculating step; therefore, it is not necessary to store peak and bottom deviation values for each one of innumerably existing transitional positions in the EEPROM 134. Thus, a memory size for the EEPROM 134 may be maintained smaller. Further, while the discharging timings for the transitional positions are calculated based on the adjusted peak deviation values αY(m) adjusted by the peak adjusting values α and the adjusted bottom deviation values β Y(m+1) adjusted by the bottom adjusting values β, the ink can be discharged in the adjusted preferable discharge timings.

According to the embodiment described above, the adjusting value in each unit area in the recordable range in the recording sheet 12 is determined based on the amount of ink discharged in an adjoining unit area, which adjoins the current unit area along the direction of conveyed flow 16. While the positional change in the corrugated shape of the recording sheet 12 is largely affected by the amount of ink discharged in a position close to the current recordable area, by adjusting the discharging timings based on actual distribution of the ink on the recording sheet 12, the discharging timings to discharge the ink can be adjusted even more preferably. In this regard, however, the adjusting value of the discharging timing of the ink is not necessarily be calculated based on the amount of the discharged ink in the adjoining unit area along the direction of conveyed flow 16 alone. In other words, the adjusting value may be calculated based on an amount of the ink to be discharged in a unit area, which is in a downstream position with respect to the current unit area along the direction of conveyed flow 16.

Meanwhile, in the discharged ink amount calculating step (S17), the amount of the discharged ink may not necessarily be calculated on the unit area basis. For example, in S17, a sum of the ink having been discharged in the recording sheet 12 may be used as the amount of the discharged ink. For another example, an amount of discharged ink may be calculated on the recordable range basis. In the latter example, the controller 130 may obtain the peak adjusting values α and the bottom adjusting values β, which are associated with an amount of the ink discharged in a previous recordable range adjoining the current recordable range along the direction of conveyed flow 16, from the EEPROM 134. Further, in the latter example, when the ink is discharged at a recordable range, which partly overlaps the previous recordable range, the controller 130 may calculate a sum of the amounts of the ink having been accumulatively discharged at the current recordable range up to the time of the calculation.

In the embodiment described above, it has been described that the reference value D0 is a parameter representing the reference timing, and the peak deviation value Y(m) and the bottom deviation value Y(m+1) are parameters representing the deviated distances. However, the parameters for the adjustment may not necessarily be limited to those, but other parameters which can specify the discharging timings may arbitrarily be used. For example, the reference value D0 , the peak deviation value Y(m), and the bottom deviation value Y(m+1) may be expressed by timings or in distances uniformly.

In the embodiment described above, in the timing information obtaining step (S13), the controller 130 obtains the reference value D0 and the peak deviation value Y(m) to specify the discharge timing for the peak 12A on the dry recording sheet 12 and obtains the reference value D0 and the bottom deviation value Y(m+1) to specify the discharge timing for the bottom 12B on the dry recording sheet 12. The obtainment in S13 is based on an assumption that the height of the peak 12A and the depth of the bottom 12B of the corrugated shape in the recording sheet 12 formed by the corrugation mechanism may not necessarily be symmetrical along the vertical direction 7.

Meanwhile, if it is assumed that the height of the peak 12A and the depth of the bottom 12B of the corrugated shape in the recording sheet 12 formed by the corrugation mechanism are symmetrical along the vertical direction 7, in S13, the controller 130 may obtain the reference value D0 and a single deviation value, which is common between the peak 12A and the bottom 12B, for the peak 12A and the bottom 12B. In this case, the reference value D0 may be decreased by the deviation value to be smaller in order to obtain a delayed discharging timing for the peak 12A on the dry recording sheet 12. Meanwhile, the reference value D0 may be increased by the deviation value to be larger in order to obtain an advanced discharging timing for the bottom 12B on the dry recording sheet 12.

Although an example of carrying out the invention has been described, those skilled in the art will appreciate that there are numerous variations and permutations of the inkjet printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

[Modified Example 1]

Next, with reference to FIG. 12, a first modified example of the embodiment according to the present invention will be described. In the first modified example described below, description of configurations or steps which are differed from the previous embodiment will be provided, and description of the configurations and steps which are similar to or the same as those described in the previous embodiment will be omitted. In the first modified example, it is common with the previous embodiment that the peaks 12A in the wet recording sheet 12 absorbing the discharged ink shift upward, but it is different from the previous embodiment that the bottoms 12B in the wet recording sheet 12 also shift upward.

In FIG. 12, the corrugated shape of a dry recording sheet 12, on which no ink is discharged yet, is indicated by a solid line while the corrugated shape of a wet recording sheet 12, on which the ink has been discharged, is indicated by a broken line. In the first modified example, the corrugated shape of the wet recording sheet 12 absorbing the discharged ink is drawn based on an assumption that the peaks 12A and the bottoms 12B of the wet recording sheet 12 should shift upward to be closer the recording head 39. Further, the first modified example described below is based on an assumption that a shifted amount of the peaks 12A is greater than a shifted amount of the bottoms 12B with respect to a same amount of the discharged ink. However, the relativity of the shifted amounts between the peaks 12A and the bottoms 12B may be inverted. In other words, a shifted amount of the peaks 12A may be smaller than a shifted amount of the bottoms 12B with respect to the same amount of the discharged ink. Therefore, the controller 130 should determine the discharging timings for each peak 12A and bottom 12B individually.

More specifically, the peak adjusting value $\alpha$ is a value, which is greater than or equal to 1 and is increased to be greater in correspondence to a greater amount of the discharged ink. In other words, the greater the amount of the discharged ink is provided, the greater the peak adjusting value $\alpha$ becomes. Thus, the peak adjusting value $\alpha$ amplifies the absolute value of the peak deviation value Y(m) to be greater as the greater amount of the discharged ink is provided. On the other hand, the bottom adjusting value $\beta$ is a value, which is smaller than or equal to 1 and is decreased to be smaller in correspondence to a greater amount of the discharged ink. In other words, the greater the amount of the discharged ink is provided, the smaller the bottom adjusting value becomes. Thus, the bottom adjusting value $\beta$ reduces the absolute value of the peak deviation value Y(m+1) to be smaller as the greater amount of the discharged ink is provided. With the characteristics of the peak adjusting value $\alpha$ and the bottom adjusting value $\beta$, in the image recording operation shown in FIG. 7, the timing information obtaining step (S13), the discharging timing correcting step (S14), and the discharging timing calculating step (S15) are performed similarly to those described in the previous embodiment. The reminder of the processes described above is performed similarly, and description of those will be herein omitted.

According to the corrected discharging timings (i.e., D0+$\alpha$Y(m)/2V) for the peaks 12A, the ink is discharged at delayed timings, which are later than the discharging timing (D0+Y(m)/2V) of the ink to be discharged at the peak 12A in the dry recording sheet 12. In this regard, the greater the amount of discharged ink is, the later the corrected discharging timings for the peaks 12A are delayed from the discharging timings designated by the reference value D0. Meanwhile, according to the corrected discharging timings (i.e., D0+$\beta$Y(m+1)/2V) for the bottoms 12B, the ink is discharged at delayed timings, which are later than the discharging timing (D0+Y(m+1)/2V) of the ink to be discharged at the bottom 12B in the dry recording sheet 12 and closer to the discharging timings specified by the reference value D0 with respect to the discharging timing (D0+Y(m+1)/2V) of the ink to be discharged at the bottom 12B of the dry recording sheet 12. In other words, the corrected discharging timings (i.e., D0+$\beta$Y(m+1)/2V) for the bottoms 12B are delayed to be later than the discharging timing for the bottoms 12B of the dry recording sheet 12 but are still advanced from the discharging timings specified by the reference value D0.

Thus, by modifying the interrelation between the amount of discharged ink and the adjusting values, the discharging timings can be suitably adjusted in correspondence to any pattern of the recording sheet 12 absorbing the ink. For example, the previous embodiment and the first modified example are not exclusive to each other but may be combined with each other. Therefore, for example, as long as the amount of the discharged ink is within a predetermined range, the bottom adjusting value $\beta$ may be decreased to be smaller as the greater amount of the discharged ink is provided. Meanwhile, once the amount of the discharged ink exceeds the predetermined range, the bottom adjusting value $\beta$ may be increased to be greater as the greater amount of the discharged ink is provided. With the varied adjustment based on the bottom adjusting values $\beta$, deformation of the recording sheet 12, in which the bottoms 12B are pulled upward by the peaks 12A when the amount of the discharged ink is smaller, and in which the bottoms 12B are drawn downward by weight of the discharged ink when the amount of the discharged ink is greater, may be suitably compensated.

In the discharging timing correcting step mentioned in the previous embodiment and the first modified example described above, the peak deviation value Y(m) and the bottom deviation value Y(m+1) may not necessarily be multiplied by the peak adjusting value $\alpha$ and the bottom adjusting value $\beta$ respectively. Rather, for example, the controller 130 may add the peak adjusting value $\alpha$ to the peak deviation value Y(m), i.e., a+Y(m), and add the bottom adjusting value β to the bottom deviation value Y(m+1), i.e., β+Y(m+1). In this regard, according to the previous embodiment, the peak adjusting value α is a value, which is smaller than or equal to 0 and is decreased to be smaller in correspondence to an amount of the discharged ink being increased. In other words, the greater amount of the discharged ink is provided, the smaller the peak adjusting value α becomes. Meanwhile, the bottom adjusting value β is a value, which is greater than or equal to 0 and is increased to be larger in correspondence to an amount of the discharged ink being increased. In other words, the greater amount of the discharged ink is provided, the greater the bottom adjusting value β becomes. On the other hand, in the first modified example, the peak adjusting value α and the bottom adjusting value β are smaller than or equal to 0 and are decreased to be smaller in correspondence to an amount of the discharged ink being increased. In other words, the greater the amount of the discharged ink is, the smaller the peak adjusting value α and the bottom adjusting value β become.

[Modified Example 2]

Next, with reference to FIG. 13, a second modified example of the embodiment according to the present invention will be described. In the second modified example described below, description of configurations or steps which are differed from the previous embodiment will be provided, and description of the configurations and steps which are similar to those described in the previous embodiment will be omitted. In the second modified example, it is common with the previous embodiment that the peaks 12A in the wet recording sheet 12 absorbing the discharged ink shift upward and the bottoms 12B in the wet recording sheet 12 shift downward. Meanwhile it is different from the previous embodiment that the height of the shifted peaks 12A and the depth of the shifted bottoms 12B of the corrugated shape in the wet recording sheet 12 are symmetrical along the vertical direction 7. Therefore, in the second modified example, the peak deviation values Y(m) and the bottom deviation values Y(m+1) are adjusted by a common adjusting value.

In the second modified example, as shown in FIG. 13, the EEPROM 134 stores a plurality of adjusting values γ, each of which is associated with one of a plurality of amounts of discharged ink. The adjusting values γ are used commonly for adjusting the peak deviation values Y(m) and the bottom deviation values Y(m+1). The adjusting value γ is a value, which is greater than or equal to 1 and is increased to be greater in correspondence to an amount of the discharged ink being increased. Thus, the adjusting value γ amplifies the absolute values of the peak deviation value Y(m) and the bottom deviation value Y(m+1) to be greater as the greater amount of the discharged ink is provided. Within the adjusting values γ shown in FIG. 13, 1 is the smallest and γ5 is the greatest ($1<\gamma1<\gamma2<\gamma3<\gamma4<\gamma5$).

In the timing information obtaining step (S13) in the second modified example, the controller 130 obtains one of the adjusting values γ corresponding to a sum (or an average) of the ink discharged in a recordable range (e.g., range 12G shown in FIG. 11) from the EEPROM 134. Thereafter, in the timing information obtaining step, the controller 130 multiplies the peak deviation values Y(m) and the bottom deviation values Y(m+1) by the obtained adjusting value γ respectively. Thus, the adjusted peak deviation values γY(m) and the adjusted bottom deviation values γY(m+1) are obtained. Thus, the adjusting value γ adjusts the absolute values of the peak deviation value Y(m) and the bottom deviation value Y(m+1) to be greater as the greater amount of the discharged ink is provided.

Further, in the discharging timing calculating step (S15) in the second modified example, the controller 130 fills the expression 1 with the unadjusted peak deviation values Y(m) and the unadjusted bottom deviation values Y(m+1), which are not yet multiplied by the adjusting value γ. Thereby, a deviation value y', which indicates a deviated amount between the targeted transitional position and a landing position for the ink discharged D0 second(s) before the carriage 23 reaches a position straight above the transitional position along the widthwise direction 9, is calculated. Thereafter, the controller 130 fills an expression 3 described below with the deviation value y', the adjusting value γ, and the reference value D0. Thus, the discharging timings to discharge the ink toward the transitional positions are obtained. In other words, the deviation value y' multiplied by the adjusting value is divided by the moving velocity V (or 2V in the second modified example) of the carriage 23, and the reference value D0 is added thereto.

$$D_{(x)} = \frac{\gamma y'}{2V} + D_0 \qquad \text{(Expression 3)}$$

According to the corrected discharging timings (i.e., D0+γY(m)/2V) for the peaks 12A, the ink is discharged in delayed timings, which are even later than the discharging timing (D0+Y(m)/2V) of the ink to be discharged at the peaks 12A in the dry recording sheet 12. Meanwhile, according to the corrected discharging timings (i.e., D0+yY(m+1)/2V) for the bottoms 12B, the ink is discharged at advanced timings, which are even earlier than the discharging timing (D0+Y(m+1)/2V) of the ink to be discharged at the bottoms 12B in the dry recording sheet 12. In this regard, the greater the amount of discharged ink is provided, the later the corrected discharging timings for the peaks 12A are delayed from the discharging timings specified by the reference value D0. On the other hand, the greater the amount of the discharged ink is provided, the earlier the corrected discharging timings for the bottoms 12B are advanced from the discharging timings specified by the reference value D0.

In the second modified example described above, in the discharging timing calculating step, the controller 130 may calculate a sum (or an average) of the amounts of the ink discharged in a single recording operation. In other words, it may not be necessary to divide the recording sheet 12 into a plurality of unit areas and calculate the amount of discharged ink on the unit area basis.

[More Examples]

Next, with reference to FIGS. 14A-14D, flows to modify the discharge timings depending on other factors than the amount of discharged ink will be described. The flows shown in FIGS. 14A-14D may be, for example, applied to the corrected discharging timings obtained in the discharging timing correcting step (S14) and the discharging timing calculating step (S15). Alternatively, the adjusting values α, β, γ obtained in the timing information obtaining step (S 13) may be modified through the flows shown in FIGS. 14A-14D.

With reference to FIG. 14A, a flow to modify the corrected discharging timings depending on a posture of the recording sheet 12 will be described. In the flow shown in FIG. 14A, the corrected discharging timings are further modified depending on whether the recording sheet 12 is nipped by either one of the conveyer roller unit 54 and the ejection roller unit 55 (i.e., in a single-nipped posture) or by both of the conveyer roller unit 54 and the ejection roller unit 55 (in a bi-nipped posture). When the recording sheet 12 is in the single-nipped posture, the recording sheet 12 tends to shift upward to be closer to the recording head 39 compared to the recording sheet 12 in the bi-nipped posture.

As the flow starts, in S31, the controller 130 judges whether the recording sheet 12 is the single-nipped posture. The judgment may be made based on combination of the detected signals from the registration sensor 160 and the pulse signals from the rotary encoder 170. In particular, the controller 130 determines that the recording sheet 12 is in the single-nipped posture after the leading end of the recording sheet 12 passes through the conveyer roller unit 54 and until the leading end of the recording sheet 12 reaches the ejection roller unit 55. Thereafter, the controller 130 determines that the recording sheet 12 is nipped by both of the conveyer roller unit 54 and the ejection roller unit 55 until the tail end of the recording sheet 12 passes through the conveyer roller unit 54. Thereafter, the controller 130 determines that the recording sheet 12 is in the cantilevered posture until the rear end of the recording sheet 12 passes through the ejection roller unit 55.

If the controller 130 judges that the recording sheet 12 is in the single-nipped posture (S31: YES), in S32, the controller 130 modifies the discharging timings corrected through the discharging timing correcting step (S14) and the discharging timing calculating step (S15) to be delayed. More specifically, the controller 130 adds a deviation value to the corrected discharging timings or multiplies the corrected discharging timings by the deviation value. Meanwhile, in S31, if the controller judges that the recording sheet 12 is in the bi-nipped posture (S31: NO), the controller 130 skips S32.

The flow shown in FIG. 14A may be applied to modify the discharging timings, which have been corrected for the recording sheet 12 in the bi-nipped posture through the discharging timing correcting step (S14) and the discharging timing calculating step (S15). Therefore, through S31-S32, the discharging timings having been corrected for the recording sheet 12 in the bi-nipped posture may be modified to be delayed for the recording sheet 12 in the single-nipped posture. However, the flow may be applied to modify the discharging timings, which have been corrected through S14-S15 for the recording sheet 12 in the single-nipped posture, for the recording sheet 12 in the bi-nipped posture. In other words, the discharging timings corrected for the recording sheet 12 in the single-nipped posture may be modified to be delayed with respect to the discharging timings corrected for the equivalent position on the recording sheet 12 in the bi-nipped posture.

Next, with reference to FIG. 14B, a flow to modify the corrected discharging timings depending on a type of the recording sheet 12 will be described. The flow shown in FIG. 14B is based on an assumption that the corrugated shape in a less rigid recording sheet 12 tends to shift for a larger amount when the recording sheet 12 absorbs the ink compared to a more rigid recording sheet 12. Therefore, when the less rigid recording sheet 12 becomes wet by the discharged ink, the peaks 12A shift further upward while the bottoms 12B shift further downward compared to the positions of the peaks 12A and the bottoms 12B in the rigid recording sheet 12.

As the flow starts, in S41, the controller 130 judges a type of the recording sheet 12. The judgment may be made, for example, based on information indicating the type of the recording sheet 12, which may be included in the image recording instruction. If the recording sheet 12 is a plain sheet (S41: YES), in S42, the controller 130 amplifies the corrected amounts of the corrected discharging timings. In particular, the controller 130 modifies the corrected discharging timings for the peaks 12A to be delayed to be later than the corrected discharging timings and the corrected discharging timings for the bottoms 12B to be advanced to be earlier than the corrected discharging timings. Meanwhile, if the recording sheet 12 is a glossy sheet (S41: NO), the controller 130 skips S42.

In the flow shown in FIG. 14B, the corrected discharging timings are modified depending on the type of the recording sheet 12. However, the type of the recording sheet 12 may not necessarily be limited to the plain sheet and the glossy sheet. For example, the judgment in S41 may be made between the glossy sheet and a postcard being more rigid than the glossy sheet. That is, when the recording sheet 12 is the glossy sheet, amounts to modify the corrected discharging timings may be amplified to be greater than amounts to modify the corrected discharging timings for the postcard. In other words, the amounts to modify the corrected discharging timings for a less rigid recording sheet 12 may be greater than the amounts to modify a more rigid recording sheet 12.

The flow shown in FIG. 14B may be applied to modify the discharging timings, which have been corrected for the recording sheet 12 being the glossy sheet through the discharging timing correcting step (S14) and the discharging timing calculating step (S15). Therefore, through S41-S42, the discharging timings having been corrected for the recording sheet 12 being the rigid sheet paper may be modified to be delayed for the recording sheet 12 being the less rigid plain sheet However, the discharging timings having been corrected may not necessarily be modified between the plain sheet and the glossy sheet. For example, the controller 130 may determine corrected discharging timings for a reference recording sheet having reference rigidity through S14-S15 and may modify the discharging timings corrected for the reference sheet depending on rigidity of a current recording sheet 12. In particular, when the current recording sheet 12 is more rigid than the reference rigidity, the corrected discharging timings corrected for the reference rigidity may be modified for the current recording sheet 12 for smaller amounts. On the other hand, when the current recording sheet 12 is less rigid than the reference rigidity, the corrected discharging timings corrected for the reference rigidity may be modified for the current recording sheet 12 for larger amounts.

Next, with reference to FIG. 14C, a flow to modify the corrected discharging timings depending on an aligning direction of fiber in the recording sheet 12 will be described. The recording sheet 12 to be conveyed in the printer part 11 may be placed, for example, to have the fiber therein to align along the direction of the conveyed flow 16, i.e., along the front-rear direction 8. For another example, the recording sheet 12 to be conveyed in the printer part 11 may be placed to have the fiber therein to align across the direction of the conveyed flow 16, i.e., along the width-wide direction 9. The former alignment of the fiber in the recording sheet 12 will be referred to as parallel alignment, and the latter alignment of the fiber in the recording sheet 12 will be referred to as crosswise alignment. When the recording sheet 12 is placed to have the fiber in the parallel alignment, the corrugated shape in the recording sheet 12 absorbing the ink tends to shift largely compared to the recording sheet 12 with the fiber in the crosswise alignment. More specifically, in the recording sheet 12 with the fiber in the crosswise alignment, rigidity in the recording sheet 12 along the vertical direction 7 is enhanced by the ripples formed by the corrugation mechanism. Meanwhile, in the recording sheet 12 with the fiber in the parallel alignment, rigidity in the recording sheet 12 along the vertical direction 7 is reduced. Therefore, when the recording sheet 12 absorbs the ink, the peaks 12A in the wet recording sheet 12 with the fiber in the parallel alignment tend to shift further upward while the bottoms 12B in the wet recording sheet 12 with the fiber in the parallel alignment tend to shift further downward compared to the wet recording sheet 12 with the fiber in the crosswise alignment.

Therefore, as the flow starts, in S51, the controller 130 judges alignment of the fiber in the recording sheet 12. The judgment may be made, for example, based on information indicating the alignment of the fiber in the recording sheet 12 (i.e., information concerning a size and/or arrangement of the recording sheet 12), which may be included in the image recording instruction. If the recording sheet 12 is in the parallel alignment (S51: YES), in S52, the controller 130 amplifies the corrected amounts of the corrected discharging timings. In particular, the controller 130 modifies the corrected discharging timings for the peaks 12A to be delayed and the corrected discharging timings for the bottoms 12B to be advanced from the corrected discharging timings. Meanwhile, if the recording sheet 12 is not in the parallel alignment but is in the crosswise alignment (S51: NO), the controller 130 skips S52.

The flow shown in FIG. 14C may be applied to modify the discharging timings, which have been corrected for the recording sheet 12 in the crosswise alignment through the discharging timing correcting step (S14) and the discharging timing calculating step (S15). Therefore, through S51-S52, the discharging timings having been corrected for the recording sheet 12 in the crosswise alignment may be modified for the recording sheet 12 in the parallel alignment. However, for example, the controller 130 may determine corrected discharging timings for a recording sheet 12 in the parallel alignment through S14-S15 and may modify the corrected discharging timings for the current recording sheet 12 in the crosswise alignment. In particular, when the current recording sheet 12 is in the crosswise alignment, the corrected discharging timings corrected for the parallel alignment may be modified for the current recording sheet 12 for smaller amounts.

Next, with reference to FIG. 14D, a flow to modify the corrected discharging timings when a dry-wait process is performed for the recording sheet 12 will be described. The dry-wait process may be applied to the recording sheet 12 when the amount of the ink discharged to the recordable range in a previous image recording step (S16) exceeds a predetermined threshold amount, and when the dry-wait process is performed, a next image recording step (S16) is suspended for a predetermined waiting period. In this regard the corrugated shape in the recording sheet 12 having been through the dry-wait process tends to shift for smaller amounts compared to the corrugated shape in the recording sheet 12 which has not been through the dry-wait process.

Therefore, as the flow starts, in S61, the controller 130 judges whether the dry-wait process has been performed for the recording sheet 12. If the dry-wait process has been performed (S61: YES), in S62, the controller 130 modifies the corrected discharging timings for smaller amounts. In particular, the controller 130 modifies the corrected discharging timings for the peaks 12A to be advanced and the corrected discharging timings for the bottoms 12B to be delayed. Meanwhile, if no dry-wait process has been performed (S61: NO), the controller 130 skips S62.

Each of the modifying flows shown in FIGS. 14A-14D may be performed alone or in combination with one another. With the modifying flows, the ink may be discharged at the recording sheet 12 in even more preferable discharging timings according to the condition of the recording sheet 12.

What is claimed is:

1. An inkjet printer comprising:

a recording head formed to have a plurality of nozzles and configured to discharge ink through at least a given one of the plurality of nozzles at a sheet;

a carriage having the recording head and configured to move along a scanning direction;

a corrugation mechanism configured to form a corrugated shape that has protrusive points protruding toward the recording head and recessed points recessed from the recording head in the sheet, each of the protruding points and each of the recessed points being arranged alternately along the scanning direction;

a memory device configured to store:

a reference discharging timing, the reference discharging timing being a reference period earlier than a reference timing, at which the given one of the plurality of nozzles formed in the recording head faces with a center point, the center point including a center of the protrusive points and the recessed points;

a protrusion deviation value corresponding to a deviation between a first period and the reference period, the protrusion deviation value being the first period earlier than a first timing at which the given one of the plurality of the nozzles formed in the recording head faces one of the protrusive points, the first period being shorter than the reference period;

a recess deviation value corresponding to a deviation between a second period and the reference period, the recess deviation value being the second period earlier than a second timing at which the given one of the plurality of the nozzles formed in the recording head faces one of the recessed points, the second period being longer than the reference period;

protrusion adjusting values to adjust the protrusion deviation value, each of the protrusion adjusting values being associated with one of different amounts of discharged ink; and recess adjusting values to adjust the recess deviation value, each of the recess adjusting values being associated with one of the different amounts of discharged ink, and a controller configured to execute steps comprising:

a discharged ink amount calculating step, in which the controller calculates an amount of the ink having been discharged from the recording head at the sheet;

a determining step, in which the controller determines one of the protrusion adjusting values and one of the recess adjusting values, both the one of the protrusion adjusting values and one of the recess adjusting values corresponding to the calculated amount of the ink in the calculating step;

an obtaining step, in which the controller obtains the reference discharging timing, the protrusion deviation value, the recess deviation value, the determined one of the protrusion adjusting values, and the determined one of the recess adjusting values from the memory device;

a correcting step, in which the controller corrects the obtained protrusion deviation value based on the determined one of the protrusion adjusting values and by correcting the first period and the obtained recess deviation value based on the determined one of the recess adjusting values and by correcting the second period;

a discharging timing calculating step, in which the controller calculates a protrusion discharging timing and a recess discharging timing, the protrusion discharging timing being calculated based on the reference discharging timing and the corrected protrusion deviation value, the recess discharging timing being calculated based on the reference discharging timing and the corrected recess deviation value; and a discharging step, in which the carriage is moved along the scanning direction and the recording head is manipulated to discharge the ink at the sheet in the calculated protrusion discharging timing and the calculated recess discharging timing;

wherein an amount of correction between the first period after the correcting step corrected for a given one of the protrusion adjusting values associated with a given one of the different amounts of discharged ink and the first period prior to the correcting step is greater than an amount of correction between the corrected second period after the correcting step corrected for a given one of the recess adjusting values associated with the same given one of the different amounts of discharged ink and the second period prior to the correcting step.

2. The inkjet printer according to claim 1, wherein, in the correcting step, the greater amount the calculated amount of the discharged ink indicates, the shorter the controller corrects the first period between the first timing and the protrusion discharging timing, and the longer the controller corrects the second period between the second timing and the recess discharging timing.

3. The inkjet printer according to claim 2, wherein the protrusion adjusting values and the recess adjusting values increase absolute values of the protrusion deviation value and the recess deviation value respectively as the calculated amount of the discharged ink indicates greater amount;

wherein, in the obtaining step, the controller obtains the reference discharging timing, the protrusion deviation value, the recess deviation value, and both one of the protrusion adjusting values and one of the recess adjusting values associated with the one of the different amounts of discharged ink corresponding to the calculated amount of discharged ink, from the memory device; and wherein, in the correcting step, the controller corrects the first period by adjusting the obtained protrusion deviation value with use of the determined one of the protrusion adjusting values, and the controller corrects the second period by adjusting the obtained recess deviation value with use of the determined one of the recess adjusting values.

4. The inkjet printer according to claim 3, wherein, in the discharging step, the controller manipulates the recording head to discharge the ink at a recordable range while the carriage is being moved from one side toward the other side along the scanning direction, the recordable range ranging for a predetermined dimension along a sheet conveyed direction, which is orthogonal to the scanning direction, the recordable range being divided into a plurality of unit areas along the sheet conveyed direction;

wherein each of the unit areas contains one of the protrusive points or one of the recessed points;

wherein, in the discharged ink amount calculating step, the controller calculates the amount of ink having been discharged from the recording head at each unit area in a former recordable range which has been through the discharging step formerly; and wherein, in the obtaining step, the controller obtains the determined one of the protrusion adjusting values and the determined one of the recess adjusting values associated with the one of the different amounts of discharged ink corresponding to the calculated amount of discharged ink for each unit area in the former recordable range, which adjoins a current recordable range at a downstream side along the sheet conveyed direction, from the memory device.

5. The inkjet printer according to claim 1, wherein, in the correcting step, the greater amounts the calculated amount of discharged ink indicates, the shorter the controller corrects the first period between the first timing and the protrusion discharging timing, and the shorter the controller corrects the second period between the second timing and the recess discharging timing.

6. The inkjet printer according to claim 5 wherein the protrusion adjusting values increase an absolute value of the protrusion deviation value as the calculated amount of the discharged ink indicates greater amount, and the recess adjusting values reduce an absolute value of the recess deviation value as the calculated amount of the discharged ink indicates greater amount;

wherein, in the obtaining step, the controller obtains the reference discharging timing, the protrusion deviation value, the recess deviation value, and both of the determined one of the protrusion adjusting values and the determined one of the recess adjusting values associated with the one of the different amounts of discharged ink corresponding to the calculated amount of discharged ink, from the memory device; and wherein, in the correcting step, the controller corrects the first period by adjusting the obtained protrusion deviation value with use of the determined one of the protrusion adjusting values, and the controller corrects the second period by adjusting the obtained recess deviation value with use of the determined one of the recess adjusting values.

7. The inkjet printer according to claim 6, wherein, in the discharging step, the controller manipulates the recording head to discharge the ink at a recordable range while the carriage is being moved from one side toward the other side along the scanning direction, the recordable range ranging for a predetermined dimension along a sheet conveyed direction, which is orthogonal to the scanning direction, the recordable range being divided into a plurality of unit areas along the sheet conveyed direction;

wherein each of the unit areas contains one of the protrusive points or one of the recessed points;

wherein, in the discharged ink amount calculating step, the controller calculates the amount of ink having been discharged from the recording head at each unit area in a former recordable range which has been through the discharging step formerly; and wherein, in the obtaining step, the controller obtains the determined one of the protrusion adjusting values and the determined one of the recess adjusting values associated with the one of the different amounts of discharged ink corresponding to the calculated amount of discharged ink for each unit area in the former recordable range, which adjoins a current recordable range at a downstream side along the sheet conveyed direction, from the memory device.

8. The inkjet printer according to claim 1, wherein, in the discharging step, the controller manipulates the recording head to discharge the ink at a recordable range while the carriage is being moved from one side toward the other side along the scanning direction, the recordable range ranging for a predetermined dimension along a sheet moving direction, which is orthogonal to the scanning direction;

wherein, in the discharged ink amount calculating step, the controller calculates the amount of ink having been discharged from the recording head at a former recordable range which has been through the discharging step formerly; and wherein, in the correcting step, the controller corrects the first period and the second period based on the calculated amount of the ink having been discharged from the recording head at at least one of former recordable ranges which has been through the discharging step most recently.

9. The inkjet printer according to claim 8, wherein, in the discharging step, the controller manipulates the recording head to discharge the ink at a current recordable range, which partly overlaps the one of the former recordable ranges having been through the discharging step most recently; and wherein, in the discharged ink amount calculating step, the controller calculates the amount of discharged ink by summing amounts of the ink having been accumulatively discharged at the current recordable range.

10. The inkjet printer according to claim 1, further comprising:

a first conveyer roller unit and a second conveyer roller unit, which are arranged to interpose the recording unit in there-between along a sheet conveyed direction, which is orthogonal to the scanning direction, each of the first conveyer roller unit and the second conveyer roller unit being configured to nip the sheet and convey along the sheet conveyed direction, wherein, in the correcting step, the controller corrects both the first period, which is between the first timing and the protrusion discharging timing, and the second period, which is between the second timing and the recess discharging timing, when the sheet is nipped by one of the first conveyer roller unit and the second conveyer unit, to be shorter than the first period, which is between the first timing and the protrusion discharging timing, and the second period, which is between the second timing and the recess discharging timing, when the sheet is nipped by both of the first conveyer roller unit and the second conveyer unit.

11. The inkjet printer according to claim 1, further comprising:

a conveyer unit configured to convey the sheet toward the recording head; and a platen configured to support a lower surface of the sheet while an upper surface of the sheet faces the recording head to have the ink discharged thereat, wherein the corrugation mechanism comprises:

a plurality of contact pieces, which are arranged on upstream positions with respect to the recording head along a sheet conveyed direction in positions spaced apart from one another along the scanning direction and are arranged to be in contact with the upper surface of the sheet; and a plurality of ribs, which are formed on the platen and are arranged to contact the lower surface of the sheet at upper positions with respect to lower ends of the contact pieces, and wherein each of the contact pieces and each of the ribs are arranged alternately along the scanning direction.

12. A method to control an inkjet printer by controlling a recording head to discharge ink at a corrugated sheet having protrusive points and recessed points each arranged alternately along a scanning direction based on information stored in a memory device, the information including:

a reference discharging timing, the reference discharging timing being a reference period earlier than a reference timing, at which a given one of a plurality of nozzles formed in the recording head faces with a center point, the center point including a center of the protrusive points and the recessed points;

a protrusion deviation value corresponding to a deviation between a first period and the reference period, the protrusion deviation value being the first period earlier than a first timing at which the given one of the plurality of the nozzles formed in the recording head faces one of the protrusive points, the first period being shorter than the reference period;

a recess deviation value corresponding to a deviation between a second period and the reference period, the recess deviation value being the second period earlier than a second timing at which the given one of the plurality of the nozzles formed in the recording head faces one of the recessed points, the second period being longer than the reference period;

protrusion adjusting values to adjust the protrusion deviation value, each of the protrusion adjusting values being associated with one of different amounts of discharged ink; and recess adjusting values to adjust the recess deviation value, each of the recess adjusting values being associated with one of the different amounts of discharged ink, the method comprising:

calculating an amount of the ink having been discharged at the corrugated sheet from the recording head mounted on a carriage;

determining one of the protrusion adjusting values and one of the recess adjusting values, both the one of the protrusion adjusting values and one of the recess adjusting values corresponding to the calculated amount of the ink;

obtaining the reference discharging timing, the protrusion deviation value, the recess deviation value, the determined one of the protrusion adjusting values, and the determined one of the recess adjusting values from the memory device;

correcting the obtained protrusion deviation value based on the determined one of the protrusion adjusting values and by correcting the first period and the obtained recess deviation value based on the determined one of the recess adjusting values and by correcting the second period;

calculating a protrusion discharging timing and a recess discharging timing, the protrusion discharging timing being calculated based on the reference discharging timing and the corrected protrusion deviation value, the recess discharging timing being calculated based on the reference discharging timing and the corrected recess deviation value;

wherein an amount of correction between the first period corrected for a given one of the protrusion adjusting values associated with a given one of the different amounts of discharged ink and the first period without correction is greater than an amount of correction between the second period corrected for a given one of the recess adjusting values associated with the same given one of the different amounts of discharged ink and the second period without correction.

* * * * *